US010388221B2

(12) United States Patent
Nathan et al.

(10) Patent No.: US 10,388,221 B2
(45) **Date of Patent: *Aug. 20, 2019**

(54) METHOD AND SYSTEM FOR DRIVING A LIGHT EMITTING DEVICE DISPLAY

(71) Applicant: Ignis Innovation Inc., Waterloo (CA)

(72) Inventors: Arokia Nathan, Cambridge (GB); Gholamreza Chaji, Waterloo (CA)

(73) Assignee: Ignis Innovation Inc., Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/717,043

(22) Filed: Sep. 27, 2017

(65) Prior Publication Data

US 2018/0018919 A1 Jan. 18, 2018

Related U.S. Application Data

(63) Continuation of application No. 15/090,769, filed on Apr. 5, 2016, now Pat. No. 9,805,653, which is a (Continued)

(30) Foreign Application Priority Data

| | | |
|---|---|---|
| Jun. 8, 2005 | (CA) | 2508972 |
| Feb. 20, 2006 | (CA) | 2537173 |
| Apr. 10, 2006 | (CA) | 2542678 |

(51) Int. Cl.

| | |
|---|---|
| ***G09G 5/02*** | (2006.01) |
| ***G09G 3/3233*** | (2016.01) |
| ***G09G 3/3258*** | (2016.01) |

(52) U.S. Cl.

CPC ..... *G09G 3/3233* (2013.01); *G09G 3/3258* (2013.01); *G09G 2300/043* (2013.01); (Continued)

(58) Field of Classification Search

CPC ..... G09G 2300/043; G09G 2300/0819; G09G 2300/0842; G09G 2300/0852; (Continued)

(56) References Cited

U.S. PATENT DOCUMENTS

| | | | |
|---|---|---|---|
| 3,506,851 | A | 4/1970 | Polkinghorn |
| 3,750,987 | A | 8/1973 | Gobel |

(Continued)

FOREIGN PATENT DOCUMENTS

| | | |
|---|---|---|
| AU | 729652 | 6/1997 |
| AU | 764896 | 12/2001 |

(Continued)

OTHER PUBLICATIONS

Ahnood : "Effect of threshold voltage instability on field effect mobility in thin film transistors deduced from constant current measurements"; dated Aug. 2009.

(Continued)

*Primary Examiner* — Temesghen Ghebretinsae
*Assistant Examiner* — Sosina Abebe
(74) *Attorney, Agent, or Firm* — Stratford Managers Corporation

(57) ABSTRACT

A method and system for driving a light emitting device display is provided. The system provides a timing schedule which increases accuracy in the display. The system may provide the timing schedule by which an operation cycle is implemented consecutively in a group of rows. The system may provide the timing schedule by which an aging factor is used for a plurality of frames.

6 Claims, 22 Drawing Sheets

Related U.S. Application Data continuation of application No. 14/481,370, filed on Sep. 9, 2014, now Pat. No. 9,330,598, which is a continuation of application No. 12/893,148, filed on Sep. 29, 2010, now Pat. No. 8,860,636, which is a continuation of application No. 11/449,487, filed on Jun. 8, 2006, now Pat. No. 7,852,298.

(52) U.S. Cl.
CPC ..... *G09G 2300/0819* (2013.01); *G09G 2300/0842* (2013.01); *G09G 2300/0852* (2013.01); *G09G 2310/0216* (2013.01); *G09G 2310/0218* (2013.01); *G09G 2310/0221* (2013.01); *G09G 2310/0283* (2013.01); *G09G 2320/0233* (2013.01); *G09G 2320/043* (2013.01); *G09G 2320/045* (2013.01); *G09G 2330/021* (2013.01)

(58) Field of Classification Search
CPC ... G09G 2310/0216; G09G 2310/0218; G09G 2310/0221; G09G 2310/0283; G09G 2320/0233; G09G 2320/043; G09G 2320/045; G09G 2330/021; G09G 3/3233; G09G 3/3258
See application file for complete search history.

(56) References Cited

U.S. PATENT DOCUMENTS 3,774,055 A 11/1973 Bapat
4,090,096 A 5/1978 Nagami
4,160,934 A 7/1979 Kirsch
4,295,091 A 10/1981 Ponkala
4,354,162 A 10/1982 Wright
4,943,956 A 7/1990 Noro
4,996,523 A 2/1991 Bell
5,134,387 A 7/1992 Smith
5,153,420 A 10/1992 Hack
5,170,158 A 12/1992 Shinya
5,198,803 A 3/1993 Shie
5,204,661 A 4/1993 Hack
5,266,515 A 11/1993 Robb
5,278,542 A 1/1994 Smith
5,408,267 A 4/1995 Main
5,489,918 A 2/1996 Mosier
5,498,880 A 3/1996 Lee
5,557,342 A 9/1996 Eto
5,561,381 A 10/1996 Jenkins
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,691,783 A 11/1997 Numao
5,701,505 A 12/1997 Yamashita
5,714,968 A 2/1998 Ikeda
5,723,950 A 3/1998 Wei
5,744,824 A 4/1998 Kousai
5,745,660 A 4/1998 Kolpatzik
5,748,160 A 5/1998 Shieh
5,758,129 A 5/1998 Gray
5,815,303 A 9/1998 Berlin
5,835,376 A 11/1998 Smith
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A 11/1999 Sasaki
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,100,868 A 8/2000 Lee
6,144,222 A 11/2000 Ho
6,177,915 B1 1/2001 Beeteson
6,229,506 B1 5/2001 Dawson
6,229,508 B1 5/2001 Kane
6,246,180 B1 6/2001 Nishigaki
6,252,248 B1 6/2001 Sano
6,259,424 B1 7/2001 Kurogane
6,262,589 B1 7/2001 Tamukai
6,268,841 B1 7/2001 Cairns
6,271,825 B1 8/2001 Greene
6,288,696 B1 9/2001 Holloman
6,304,039 B1 10/2001 Appelberg
6,307,322 B1 10/2001 Dawson
6,310,962 B1 10/2001 Chung
6,320,325 B1 11/2001 Cok
6,323,631 B1 11/2001 Juang
6,329,971 B2 12/2001 McKnight
6,333,729 B1 12/2001 Ha
6,356,029 B1 3/2002 Hunter
6,373,454 B1 4/2002 Knapp
6,377,237 B1 4/2002 Sojourner
6,384,804 B1 5/2002 Dodabalapur
6,388,653 B1 5/2002 Goto
6,392,617 B1 5/2002 Gleason
6,396,469 B1 5/2002 Miwa
6,404,139 B1 6/2002 Sasaki
6,414,661 B1 7/2002 Shen et al.
6,417,825 B1 7/2002 Stewart
6,421,033 B1 * 7/2002 Williams ..... G09G 3/3233 345/103
6,430,496 B1 8/2002 Smith
6,433,488 B1 8/2002 Bu
6,437,106 B1 8/2002 Stoner
6,445,369 B1 9/2002 Yang
6,473,065 B1 10/2002 Fan
6,475,845 B2 11/2002 Kimura
6,501,098 B2 12/2002 Yamazaki
6,501,466 B1 12/2002 Yamagashi
6,518,962 B2 2/2003 Kimura
6,522,315 B2 2/2003 Ozawa
6,525,683 B1 2/2003 Gu
6,531,827 B2 3/2003 Kawashima
6,535,185 B2 3/2003 Kim
6,541,921 B1 4/2003 Luciano, Jr.
6,542,138 B1 4/2003 Shannon
6,555,420 B1 4/2003 Yamazaki
6,559,839 B1 5/2003 Ueno
6,577,302 B2 6/2003 Hunter
6,580,408 B1 6/2003 Bae
6,580,657 B2 6/2003 Sanford
6,583,398 B2 6/2003 Harkin
6,583,775 B1 6/2003 Sekiya
6,594,606 B2 7/2003 Everitt
6,618,030 B2 9/2003 Kane
6,639,244 B1 10/2003 Yamazaki
6,668,645 B1 12/2003 Gilmour
6,677,713 B1 1/2004 Sung
6,680,580 B1 1/2004 Sung
6,686,699 B2 2/2004 Yumoto
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,694,248 B2 2/2004 Smith
6,697,057 B2 2/2004 Koyama
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan

(56) References Cited

U.S. PATENT DOCUMENTS

| | | | |
|---|---|---|---|
| 6,753,655 | B2 | 6/2004 | Shih |
| 6,753,834 | B2 | 6/2004 | Mikami |
| 6,756,741 | B2 | 6/2004 | Li |
| 6,756,952 | B1 | 6/2004 | Decaux |
| 6,756,958 | B2 | 6/2004 | Furuhashi |
| 6,765,549 | B1 | 7/2004 | Yamazaki |
| 6,771,028 | B1 | 8/2004 | Winters |
| 6,777,712 | B2 | 8/2004 | Sanford |
| 6,777,888 | B2 | 8/2004 | Kondo |
| 6,781,567 | B2 | 8/2004 | Kimura |
| 6,788,231 | B1 | 9/2004 | Hsueh |
| 6,806,497 | B2 | 10/2004 | Jo |
| 6,806,638 | B2 | 10/2004 | Lih |
| 6,806,857 | B2 | 10/2004 | Sempel |
| 6,809,706 | B2 | 10/2004 | Shimoda |
| 6,815,975 | B2 | 11/2004 | Nara |
| 6,828,950 | B2 | 12/2004 | Koyama |
| 6,853,371 | B2 | 2/2005 | Miyajima |
| 6,858,991 | B2 | 2/2005 | Miyazawa |
| 6,859,193 | B1 | 2/2005 | Yumoto |
| 6,873,117 | B2 | 3/2005 | Ishizuka |
| 6,876,346 | B2 | 4/2005 | Anzai |
| 6,885,356 | B2 | 4/2005 | Hashimoto |
| 6,900,485 | B2 | 5/2005 | Lee |
| 6,903,734 | B2 | 6/2005 | Eu |
| 6,909,243 | B2 | 6/2005 | Inukai |
| 6,909,419 | B2 | 6/2005 | Zavracky |
| 6,911,960 | B1 | 6/2005 | Yokoyama |
| 6,911,964 | B2 | 6/2005 | Lee |
| 6,914,448 | B2 | 7/2005 | Jinno |
| 6,919,871 | B2 | 7/2005 | Kwon |
| 6,924,602 | B2 | 8/2005 | Komiya |
| 6,937,215 | B2 | 8/2005 | Lo |
| 6,937,220 | B2 | 8/2005 | Kitaura |
| 6,940,214 | B1 | 9/2005 | Komiya |
| 6,943,500 | B2 | 9/2005 | LeChevalier |
| 6,947,022 | B2 | 9/2005 | McCartney |
| 6,954,194 | B2 | 10/2005 | Matsumoto |
| 6,956,547 | B2 | 10/2005 | Bae |
| 6,970,149 | B2 | 11/2005 | Chung |
| 6,975,142 | B2 | 12/2005 | Azami |
| 6,975,332 | B2 | 12/2005 | Arnold |
| 6,995,510 | B2 | 2/2006 | Murakami |
| 6,995,519 | B2 | 2/2006 | Arnold |
| 7,023,408 | B2 | 4/2006 | Chen |
| 7,027,015 | B2 | 4/2006 | Booth, Jr. |
| 7,027,078 | B2 | 4/2006 | Reihl |
| 7,034,793 | B2 | 4/2006 | Sekiya |
| 7,038,392 | B2 | 5/2006 | Libsch |
| 7,053,875 | B2 | 5/2006 | Chou |
| 7,057,359 | B2 | 6/2006 | Hung |
| 7,057,588 | B2 | 6/2006 | Asano |
| 7,061,451 | B2 | 6/2006 | Kimura |
| 7,064,733 | B2 | 6/2006 | Cok |
| 7,071,932 | B2 | 7/2006 | Libsch |
| 7,088,051 | B1 | 8/2006 | Cok |
| 7,088,052 | B2 | 8/2006 | Kimura |
| 7,102,378 | B2 | 9/2006 | Kuo |
| 7,106,285 | B2 | 9/2006 | Naugler |
| 7,112,820 | B2 | 9/2006 | Chang |
| 7,113,864 | B2 | 9/2006 | Smith |
| 7,116,058 | B2 | 10/2006 | Lo |
| 7,119,493 | B2 | 10/2006 | Fryer |
| 7,122,835 | B1 | 10/2006 | Ikeda |
| 7,127,380 | B1 | 10/2006 | Iverson |
| 7,129,914 | B2 | 10/2006 | Knapp |
| 7,161,566 | B2 | 1/2007 | Cok |
| 7,164,417 | B2 | 1/2007 | Cok |
| 7,193,589 | B2 | 3/2007 | Yoshida |
| 7,224,332 | B2 | 5/2007 | Cok |
| 7,227,519 | B1 | 6/2007 | Kawase |
| 7,245,277 | B2 | 7/2007 | Ishizuka |
| 7,246,912 | B2 | 7/2007 | Burger |
| 7,248,236 | B2 | 7/2007 | Nathan |
| 7,259,737 | B2 | 8/2007 | Ono |
| 7,262,753 | B2 | 8/2007 | Tanghe |
| 7,274,363 | B2 | 9/2007 | Ishizuka |
| 7,310,092 | B2 | 12/2007 | Imamura |
| 7,315,295 | B2 | 1/2008 | Kimura |
| 7,317,434 | B2 | 1/2008 | Lan |
| 7,321,348 | B2 | 1/2008 | Cok |
| 7,327,357 | B2 | 2/2008 | Jeong |
| 7,333,077 | B2 | 2/2008 | Koyama |
| 7,339,560 | B2 | 3/2008 | Sun |
| 7,343,243 | B2 | 3/2008 | Smith |
| 7,355,574 | B1 | 4/2008 | Leon |
| 7,358,941 | B2 | 4/2008 | Ono |
| 7,368,868 | B2 | 5/2008 | Sakamoto |
| 7,397,485 | B2 | 7/2008 | Miller |
| 7,411,571 | B2 | 8/2008 | Huh |
| 7,414,600 | B2 | 8/2008 | Nathan |
| 7,423,617 | B2 | 9/2008 | Giraldo |
| 7,453,054 | B2 | 11/2008 | Lee |
| 7,466,166 | B2 | 12/2008 | Date |
| 7,474,285 | B2 | 1/2009 | Kimura |
| 7,495,501 | B2 | 2/2009 | Iwabuchi |
| 7,502,000 | B2 | 3/2009 | Yuki |
| 7,515,124 | B2 | 4/2009 | Yaguma |
| 7,528,812 | B2 | 5/2009 | Tsuge |
| 7,535,449 | B2 | 5/2009 | Miyazawa |
| 7,554,512 | B2 | 6/2009 | Steer |
| 7,569,849 | B2 | 8/2009 | Nathan |
| 7,576,718 | B2 | 8/2009 | Miyazawa |
| 7,580,012 | B2 | 8/2009 | Kim |
| 7,589,707 | B2 | 9/2009 | Chou |
| 7,595,776 | B2 | 9/2009 | Hashimoto |
| 7,604,718 | B2 | 10/2009 | Zhang |
| 7,605,792 | B2 | 10/2009 | Son |
| 7,609,239 | B2 | 10/2009 | Chang |
| 7,612,745 | B2 | 11/2009 | Yumoto |
| 7,619,594 | B2 | 11/2009 | Hu |
| 7,619,597 | B2 | 11/2009 | Nathan |
| 7,633,470 | B2 | 12/2009 | Kane |
| 7,639,211 | B2 | 12/2009 | Miyazawa |
| 7,656,370 | B2 | 2/2010 | Schneider |
| 7,675,485 | B2 | 3/2010 | Steer |
| 7,683,899 | B2 | 3/2010 | Hirakata |
| 7,688,289 | B2 | 3/2010 | Abe |
| 7,760,162 | B2 | 7/2010 | Miyazawa |
| 7,800,558 | B2 | 9/2010 | Routley |
| 7,808,008 | B2 | 10/2010 | Miyake |
| 7,847,764 | B2 | 12/2010 | Cok |
| 7,859,492 | B2 | 12/2010 | Kohno |
| 7,859,520 | B2 | 12/2010 | Kimura |
| 7,868,859 | B2 | 1/2011 | Tomida |
| 7,876,294 | B2 | 1/2011 | Sasaki |
| 7,889,159 | B2 | 2/2011 | Nathan |
| 7,903,127 | B2 | 3/2011 | Kwon |
| 7,920,116 | B2 | 4/2011 | Woo |
| 7,924,249 | B2 | 4/2011 | Nathan |
| 7,932,883 | B2 | 4/2011 | Klompenhouwer |
| 7,944,414 | B2 | 5/2011 | Shirasaki |
| 7,969,390 | B2 | 6/2011 | Yoshida |
| 7,978,170 | B2 | 7/2011 | Park |
| 7,978,187 | B2 | 7/2011 | Nathan |
| 7,989,392 | B2 | 8/2011 | Crockett |
| 7,994,712 | B2 | 8/2011 | Sung |
| 7,995,008 | B2 | 8/2011 | Miwa |
| 8,026,876 | B2 | 9/2011 | Nathan |
| 8,031,180 | B2 | 10/2011 | Miyamoto |
| 8,049,420 | B2 | 11/2011 | Tamura |
| 8,063,852 | B2 | 11/2011 | Kwak |
| 8,077,123 | B2 | 12/2011 | Naugler, Jr. |
| 8,102,343 | B2 | 1/2012 | Yatabe |
| 8,115,707 | B2 | 2/2012 | Nathan |
| 8,144,081 | B2 | 3/2012 | Miyazawa |
| 8,159,007 | B2 | 4/2012 | Bama |
| 8,208,084 | B2 | 6/2012 | Lin |
| 8,223,177 | B2 | 7/2012 | Nathan |
| 8,232,939 | B2 | 7/2012 | Nathan |
| 8,242,979 | B2 | 8/2012 | Anzai |
| 8,253,665 | B2 | 8/2012 | Nathan |
| 8,259,044 | B2 | 9/2012 | Nathan |
| 8,264,431 | B2 | 9/2012 | Bulovic |

(56) References Cited

U.S. PATENT DOCUMENTS 8,279,143 B2 10/2012 Nathan
8,283,967 B2 10/2012 Chaji
8,294,696 B2 10/2012 Min
8,314,783 B2 11/2012 Sambandan
8,319,712 B2 11/2012 Nathan
8,339,386 B2 12/2012 Leon
8,405,582 B2 3/2013 Kim
8,441,206 B2 5/2013 Myers
8,493,296 B2 7/2013 Ogawa
8,564,513 B2 10/2013 Nathan
8,581,809 B2 11/2013 Nathan
8,816,946 B2 8/2014 Nathan
8,860,636 B2 10/2014 Nathan
8,872,739 B2 10/2014 Kimura
9,125,278 B2 9/2015 Nathan
9,368,063 B2 6/2016 Chaji
9,536,460 B2 1/2017 Chaji
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0080108 A1 6/2002 Wang
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122308 A1 9/2002 Ikeda
2002/0140712 A1 10/2002 Ouchi
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0169575 A1 11/2002 Everitt
2002/0171613 A1 11/2002 Goto
2002/0180369 A1 12/2002 Koyama
2002/0180721 A1 12/2002 Kimura
2002/0181275 A1 12/2002 Yamazaki
2002/0181276 A1 12/2002 Yamazaki
2002/0183945 A1 12/2002 Everitt
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2002/0196213 A1 12/2002 Akimoto
2003/0001828 A1 1/2003 Asano
2003/0001858 A1 1/2003 Jack
2003/0016190 A1 1/2003 Kondo
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0062844 A1 4/2003 Miyazawa
2003/0063081 A1 4/2003 Kimura
2003/0071821 A1 4/2003 Sundahl
2003/0076048 A1 4/2003 Rutherford
2003/0090445 A1 5/2003 Chen
2003/0090447 A1 5/2003 Kimura
2003/0090481 A1 5/2003 Kimura
2003/0095087 A1 5/2003 Libsch
2003/0098829 A1 5/2003 Chen
2003/0107560 A1 6/2003 Yumoto
2003/0107561 A1 6/2003 Uchino
2003/0111966 A1 6/2003 Mikami
2003/0112205 A1 6/2003 Yamada
2003/0112208 A1 6/2003 Okabe
2003/0117348 A1 6/2003 Knapp
2003/0122474 A1 7/2003 Lee
2003/0122745 A1 7/2003 Miyazawa
2003/0122747 A1 7/2003 Shannon
2003/0122749 A1 7/2003 Booth, Jr.
2003/0122813 A1 7/2003 Ishizuki
2003/0128199 A1 7/2003 Kimura
2003/0142088 A1 7/2003 LeChevalier
2003/0146897 A1 8/2003 Hunter
2003/0151569 A1 8/2003 Lee
2003/0156101 A1 8/2003 Le Chevalier
2003/0156104 A1 8/2003 Morita
2003/0169241 A1 9/2003 LeChevalier
2003/0169247 A1 9/2003 Kawabe
2003/0174152 A1 9/2003 Noguchi
2003/0179626 A1 9/2003 Sanford
2003/0185438 A1 10/2003 Osawa
2003/0189535 A1 10/2003 Matsumoto
2003/0197663 A1 10/2003 Lee
2003/0210256 A1 11/2003 Mori
2003/0214465 A1 11/2003 Kimura
2003/0227262 A1 12/2003 Kwon
2003/0230141 A1 12/2003 Gilmour
2003/0230980 A1 12/2003 Forrest
2003/0231148 A1 12/2003 Lin
2004/0004589 A1 1/2004 Shih
2004/0032382 A1 2/2004 Cok
2004/0041750 A1 3/2004 Abe
2004/0066357 A1 4/2004 Kawasaki
2004/0070557 A1* 4/2004 Asano ..... G09G 3/3233 345/76
2004/0070558 A1 4/2004 Cok
2004/0070565 A1 4/2004 Nayar
2004/0090186 A1 5/2004 Yoshida
2004/0090400 A1 5/2004 Yoo
2004/0095297 A1 5/2004 Libsch
2004/0095338 A1 5/2004 Miyazawa
2004/0100427 A1 5/2004 Miyazawa
2004/0108518 A1 6/2004 Jo
2004/0129933 A1 7/2004 Nathan
2004/0130516 A1 7/2004 Nathan
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0171619 A1 9/2004 Barkoczy
2004/0174347 A1 9/2004 Sun
2004/0174349 A1 9/2004 Libsch
2004/0174354 A1 9/2004 Ono
2004/0178743 A1 9/2004 Miller
2004/0183759 A1 9/2004 Stevenson
2004/0189627 A1 9/2004 Shirasaki
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0239696 A1 12/2004 Okabe
2004/0246246 A1 12/2004 Tobita
2004/0251844 A1 12/2004 Hashido
2004/0252085 A1 12/2004 Miyagawa
2004/0252089 A1 12/2004 Ono

(56) References Cited

U.S. PATENT DOCUMENTS

2004/0256617 A1 12/2004 Yamada
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0052379 A1 3/2005 Waterman
2005/0057459 A1 3/2005 Miyazawa
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083270 A1 4/2005 Miyazawa
2005/0083323 A1 4/2005 Suzuki
2005/0088103 A1 4/2005 Kageyama
2005/0105031 A1 5/2005 Shih
2005/0110420 A1 5/2005 Arnold
2005/0110727 A1 5/2005 Shin
2005/0110807 A1 5/2005 Chang
2005/0122294 A1 6/2005 Ben-David
2005/0123193 A1 6/2005 Lamberg
2005/0140598 A1 6/2005 Kim
2005/0140600 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0219188 A1 10/2005 Kawabe
2005/0225683 A1 10/2005 Nozawa
2005/0237273 A1* 10/2005 Ozawa ..... G09G 3/3233 345/46
2005/0243037 A1 11/2005 Eom
2005/0248515 A1 11/2005 Naugler
2005/0258867 A1 11/2005 Miyazawa
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007206 A1 1/2006 Reddy
2006/0007249 A1 1/2006 Reddy
2006/0012310 A1 1/2006 Chen
2006/0012311 A1 1/2006 Ogawa
2006/0015272 A1 1/2006 Giraldo
2006/0022305 A1 2/2006 Yamashita
2006/0022907 A1 2/2006 Uchino
2006/0027807 A1 2/2006 Nathan
2006/0030084 A1 2/2006 Young
2006/0038501 A1 2/2006 Koyama
2006/0038750 A1 2/2006 Inoue
2006/0038758 A1 2/2006 Routley
2006/0038762 A1 2/2006 Chou
2006/0044227 A1 3/2006 Hadcock
2006/0061248 A1 3/2006 Cok
2006/0066533 A1 3/2006 Sato
2006/0077077 A1 4/2006 Kwon
2006/0077134 A1 4/2006 Hector
2006/0077135 A1 4/2006 Cok
2006/0077142 A1 4/2006 Kwon
2006/0077194 A1 4/2006 Jeong
2006/0082523 A1 4/2006 Guo
2006/0092185 A1 5/2006 Jo
2006/0097628 A1 5/2006 Suh
2006/0097631 A1 5/2006 Lee
2006/0103322 A1* 5/2006 Chung ..... G09G 3/3233 315/169.3
2006/0103324 A1 5/2006 Kim
2006/0103611 A1 5/2006 Choi
2006/0114196 A1 6/2006 Shin
2006/0125408 A1 6/2006 Nathan
2006/0125740 A1 6/2006 Shirasaki
2006/0139253 A1 6/2006 Choi
2006/0145964 A1 7/2006 Park
2006/0149493 A1 7/2006 Sambandan
2006/0158402 A1 7/2006 Nathan
2006/0170623 A1 8/2006 Naugler, Jr.
2006/0176250 A1 8/2006 Nathan
2006/0191178 A1 8/2006 Sempel
2006/0208961 A1 9/2006 Nathan
2006/0208971 A1 9/2006 Deane
2006/0209012 A1 9/2006 Hagood, IV
2006/0214888 A1 9/2006 Schneider
2006/0221009 A1 10/2006 Miwa
2006/0227082 A1 10/2006 Ogata
2006/0231740 A1 10/2006 Kasai
2006/0232522 A1 10/2006 Roy
2006/0244391 A1 11/2006 Shishido
2006/0244697 A1 11/2006 Lee
2006/0256048 A1 11/2006 Fish
2006/0261841 A1 11/2006 Fish
2006/0273997 A1 12/2006 Nathan
2006/0279478 A1 12/2006 Ikegami
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0001945 A1 1/2007 Yoshida
2007/0008251 A1 1/2007 Kohno
2007/0008268 A1 1/2007 Park
2007/0008297 A1 1/2007 Bassetti
2007/0035489 A1 2/2007 Lee
2007/0035707 A1 2/2007 Margulis
2007/0040773 A1 2/2007 Lee
2007/0040782 A1 2/2007 Woo
2007/0057873 A1 3/2007 Uchino
2007/0057874 A1 3/2007 Le Roy
2007/0063932 A1 3/2007 Nathan
2007/0069998 A1 3/2007 Naugler
2007/0075727 A1 4/2007 Nakano
2007/0075957 A1 4/2007 Chen
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0085801 A1 4/2007 Park
2007/0097038 A1 5/2007 Yamazaki
2007/0097041 A1 5/2007 Park
2007/0103411 A1 5/2007 Cok
2007/0103419 A1 5/2007 Uchino
2007/0109232 A1 5/2007 Yamamoto
2007/0115221 A1 5/2007 Buchhauser
2007/0126672 A1 6/2007 Tada
2007/0128583 A1 6/2007 Miyazawa
2007/0164664 A1 7/2007 Ludwicki
2007/0164937 A1 7/2007 Jung
2007/0164938 A1 7/2007 Shin
2007/0164941 A1 7/2007 Park

(56) References Cited

U.S. PATENT DOCUMENTS

2007/0182671 A1 8/2007 Nathan
2007/0236134 A1 10/2007 Ho
2007/0236430 A1 10/2007 Fish
2007/0236440 A1 10/2007 Wacyk
2007/0236517 A1 10/2007 Kimpe
2007/0241999 A1 10/2007 Lin
2007/0242008 A1 10/2007 Cummings
2007/0273294 A1 11/2007 Nagayama
2007/0285359 A1 12/2007 Ono
2007/0290957 A1 12/2007 Cok
2007/0290958 A1 12/2007 Cok
2007/0296672 A1 12/2007 Kim
2008/0001525 A1 1/2008 Chao
2008/0001544 A1 1/2008 Murakami
2008/0030518 A1 2/2008 Higgins
2008/0036706 A1 2/2008 Kitazawa
2008/0036708 A1 2/2008 Shirasaki
2008/0042942 A1 2/2008 Takahashi
2008/0042948 A1 2/2008 Yamashita
2008/0043044 A1 2/2008 Woo
2008/0048951 A1 2/2008 Naugler, Jr.
2008/0055134 A1 3/2008 Li
2008/0055209 A1 3/2008 Cok
2008/0055211 A1 3/2008 Ogawa
2008/0062106 A1 3/2008 Tseng
2008/0074413 A1 3/2008 Ogura
2008/0088549 A1 4/2008 Nathan
2008/0088648 A1 4/2008 Nathan
2008/0094426 A1 4/2008 Kimpe
2008/0111766 A1 5/2008 Uchino
2008/0116787 A1 5/2008 Hsu
2008/0117144 A1 5/2008 Nakano et al.
2008/0122819 A1 5/2008 Cho
2008/0074360 A1 6/2008 Lu
2008/0129906 A1 6/2008 Lin
2008/0136770 A1 6/2008 Peker
2008/0150845 A1 6/2008 Ishii
2008/0150847 A1 6/2008 Kim
2008/0158115 A1 7/2008 Cordes
2008/0158648 A1 7/2008 Cummings
2008/0191976 A1 8/2008 Nathan
2008/0198103 A1 8/2008 Toyomura
2008/0211749 A1 9/2008 Weitbruch
2008/0218451 A1 9/2008 Miyamoto
2008/0219232 A1 9/2008 Heubel et al.
2008/0228562 A1 9/2008 Smith
2008/0231558 A1 9/2008 Naugler
2008/0231562 A1 9/2008 Kwon
2008/0231625 A1 9/2008 Minami
2008/0231641 A1 9/2008 Miyashita
2008/0246713 A1 10/2008 Lee
2008/0252223 A1 10/2008 Toyoda
2008/0252571 A1 10/2008 Hente
2008/0259020 A1 10/2008 Fisekovic
2008/0265786 A1 10/2008 Koyama
2008/0290805 A1 11/2008 Yamada
2008/0297055 A1 12/2008 Miyake
2009/0009459 A1 1/2009 Miyashita
2009/0015532 A1 1/2009 Katayama
2009/0033598 A1 2/2009 Suh
2009/0058772 A1 3/2009 Lee
2009/0058789 A1 3/2009 Hung
2009/0109142 A1 4/2009 Takahara
2009/0121988 A1 5/2009 Amo
2009/0121994 A1 5/2009 Miyata
2009/0146926 A1 6/2009 Sung
2009/0153448 A1 6/2009 Tomida
2009/0153459 A9 6/2009 Han
2009/0160743 A1 6/2009 Tomida
2009/0174628 A1 7/2009 Wang
2009/0184901 A1 7/2009 Kwon
2009/0195483 A1 8/2009 Naugler, Jr.
2009/0201230 A1 8/2009 Smith
2009/0201281 A1 8/2009 Routley
2009/0206764 A1 8/2009 Schemmann
2009/0207160 A1 8/2009 Shirasaki
2009/0213046 A1 8/2009 Nam
2009/0225011 A1 9/2009 Choi
2009/0244046 A1 10/2009 Seto
2009/0251486 A1 10/2009 Sakakibara
2009/0262047 A1 10/2009 Yamashita
2009/0278777 A1 11/2009 Wang
2009/0289964 A1 11/2009 Miyachi
2009/0295423 A1 12/2009 Levey
2010/0004891 A1 1/2010 Ahlers
2010/0026725 A1 2/2010 Smith
2010/0033469 A1 2/2010 Nathan
2010/0039422 A1 2/2010 Seto
2010/0039451 A1 2/2010 Jung
2010/0039453 A1 2/2010 Nathan
2010/0039458 A1 2/2010 Nathan
2010/0045646 A1 2/2010 Kishi
2010/0045650 A1 2/2010 Fish
2010/0060911 A1 3/2010 Marcu
2010/0073335 A1 3/2010 Min
2010/0073357 A1 3/2010 Min
2010/0079419 A1 4/2010 Shibusawa
2010/0085282 A1 4/2010 Yu
2010/0103160 A1 4/2010 Jeon
2010/0134469 A1 6/2010 Ogura
2010/0134475 A1 6/2010 Ogura
2010/0141564 A1 6/2010 Choi
2010/0165002 A1 7/2010 Ahn
2010/0194670 A1 8/2010 Cok
2010/0207920 A1 8/2010 Chaji
2010/0207960 A1 8/2010 Kimpe
2010/0225630 A1 9/2010 Levey
2010/0225634 A1 9/2010 Levey
2010/0251295 A1 9/2010 Amento
2010/0269889 A1 10/2010 Reinhold
2010/0277400 A1 11/2010 Jeong
2010/0315319 A1 12/2010 Cok
2010/0315449 A1 12/2010 Chaji
2011/0050741 A1 3/2011 Jeong
2011/0050870 A1 3/2011 Hanari
2011/0063197 A1 3/2011 Chung
2011/0069051 A1 3/2011 Nakamura
2011/0069089 A1 3/2011 Kopf
2011/0069096 A1 3/2011 Li
2011/0074750 A1 3/2011 Leon
2011/0074762 A1 3/2011 Shirasaki
2011/0084993 A1 4/2011 Kawabe
2011/0109350 A1 5/2011 Chaji
2011/0149166 A1 6/2011 Botzas
2011/0169798 A1 7/2011 Lee
2011/0169805 A1 7/2011 Katsunori
2011/0175895 A1 7/2011 Hayakawa
2011/0181630 A1 7/2011 Smith
2011/0191042 A1 8/2011 Chaji
2011/0199395 A1 8/2011 Nathan
2011/0205221 A1 8/2011 Lin
2011/0227964 A1 9/2011 Chaji
2011/0242074 A1 10/2011 Bert
2011/0273399 A1 11/2011 Lee
2011/0279488 A1 11/2011 Nathan
2011/0292006 A1 12/2011 Kim
2011/0293480 A1 12/2011 Mueller
2012/0026146 A1 2/2012 Kim
2012/0056558 A1 3/2012 Toshiya
2012/0062565 A1 3/2012 Fuchs
2012/0169793 A1 7/2012 Nathan
2012/0262184 A1 10/2012 Shen
2012/0299970 A1 11/2012 Bae
2012/0299973 A1 11/2012 Jaffari
2012/0299976 A1 11/2012 Chen
2012/0299978 A1 11/2012 Chaji
2013/0002527 A1 1/2013 Kim
2013/0027381 A1 1/2013 Nathan
2013/0057595 A1 3/2013 Nathan
2013/0112960 A1 5/2013 Chaji
2013/0135272 A1 5/2013 Park
2013/0162617 A1 6/2013 Yoon
2013/0201223 A1 8/2013 Li
2013/0241813 A1 9/2013 Tanaka

(56) References Cited

U.S. PATENT DOCUMENTS

| | | | |
|---|---|---|---|
| 2013/0309821 | A1 | 11/2013 | Yoo |
| 2013/0321671 | A1 | 12/2013 | Cote |
| 2014/0015824 | A1 | 1/2014 | Chaji |
| 2014/0022289 | A1 | 1/2014 | Lee |
| 2014/0043316 | A1 | 2/2014 | Chaji |
| 2014/0055500 | A1 | 2/2014 | Lai |
| 2014/0111567 | A1 | 4/2014 | Nathan |
| 2014/0252988 | A1 | 9/2014 | Azizi |
| 2014/0267215 | A1 | 9/2014 | Soni |
| 2016/0275860 | A1 | 9/2016 | Wu |

FOREIGN PATENT DOCUMENTS

| | | | |
|---|---|---|---|
| CA | 1 294 034 | | 1/1992 |
| CA | 2 109 951 | | 11/1992 |
| CA | 2 249 592 | | 7/1998 |
| CA | 2 303 302 | | 3/1999 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 507 276 | | 8/2002 |
| CA | 2 463 653 | | 1/2004 |
| CA | 2 498 136 | | 3/2004 |
| CA | 2 522 396 | | 11/2004 |
| CA | 2 438 363 | | 2/2005 |
| CA | 2 443 206 | | 3/2005 |
| CA | 2 519 097 | | 3/2005 |
| CA | 2 472 671 | | 12/2005 |
| CA | 2 523 841 | | 1/2006 |
| CA | 2 567 076 | | 1/2006 |
| CA | 2526436 | | 2/2006 |
| CA | 2 526 782 | | 4/2006 |
| CA | 2 495 726 | | 7/2006 |
| CA | 2 541 531 | | 7/2006 |
| CA | 2 557 713 | | 11/2006 |
| CA | 2 526 782 | C | 8/2007 |
| CA | 2 651 893 | | 11/2007 |
| CA | 2 550 102 | | 4/2008 |
| CA | 2 672 590 | | 10/2009 |
| CA | 2 773 699 | | 10/2013 |
| CN | 1381032 | | 11/2002 |
| CN | 1448908 | | 10/2003 |
| CN | 1490779 | A | 4/2004 |
| CN | 1601594 | A | 3/2005 |
| CN | 1623180 | A | 6/2005 |
| CN | 1682267 | A | 10/2005 |
| CN | 1758309 | A | 4/2006 |
| CN | 1760945 | | 4/2006 |
| CN | 1886774 | | 12/2006 |
| CN | 1897093 | A | 1/2007 |
| CN | 101194300 | A | 6/2008 |
| CN | 101395653 | | 3/2009 |
| CN | 101449311 | | 6/2009 |
| CN | 101615376 | | 12/2009 |
| CN | 102656621 | | 9/2012 |
| CN | 102725786 | A | 10/2012 |
| DE | 202006007613 | | 9/2006 |
| EP | 0 158 366 | | 10/1985 |
| EP | 0 478 186 | | 4/1992 |
| EP | 1 028 471 | | 8/2000 |
| EP | 1 028 471 | A | 8/2000 |
| EP | 1 111 577 | | 6/2001 |
| EP | 1 130 565 | A1 | 9/2001 |
| EP | 1 194 013 | | 4/2002 |
| EP | 1 321 922 | | 6/2003 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 1 439 520 | A2 | 7/2004 |
| EP | 145 0341 | A | 8/2004 |
| EP | 1 465 143 | A | 10/2004 |
| EP | 1 469 448 | A | 10/2004 |
| EP | 1 473 689 | A | 11/2004 |
| EP | 1 517 290 | A2 | 3/2005 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| GB | 2 399 935 | | 9/2004 |
| GB | 2 460 018 | | 11/2009 |
| JP | 1272298 | | 10/1989 |
| JP | 4-042619 | | 2/1992 |
| JP | 6-314977 | | 11/1994 |
| JP | 8-340243 | | 12/1996 |
| JP | 09 090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-229513 | | 8/2002 |
| JP | 2002-278513 | | 9/2002 |
| JP | 2002-333862 | | 11/2002 |
| JP | 2003-076331 | | 3/2003 |
| JP | 2003-099000 | | 4/2003 |
| JP | 2003-124519 | | 4/2003 |
| JP | 2003-173165 | | 6/2003 |
| JP | 2003-177709 | | 6/2003 |
| JP | 2003-186439 | | 7/2003 |
| JP | 2003-195809 | | 7/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-045648 | | 2/2004 |
| JP | 2004-054188 | | 2/2004 |
| JP | 2004-133240 | | 4/2004 |
| JP | 2004-145197 | | 5/2004 |
| JP | 2004-226960 | | 8/2004 |
| JP | 2004-287345 | | 10/2004 |
| JP | 2005-004147 | | 1/2005 |
| JP | 2005-057217 | | 3/2005 |
| JP | 2005-099715 | | 4/2005 |
| JP | 2005-258326 | | 9/2005 |
| JP | 2005-338819 | | 12/2005 |
| JP | 2007-065015 | | 3/2007 |
| JP | 2007-155754 | | 6/2007 |
| JP | 2008-102335 | | 5/2008 |
| JP | 4-158570 | | 10/2008 |
| JP | 2008-542845 | A | 11/2008 |
| JP | 2003-195813 | | 7/2013 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 569173 | | 1/2004 |
| TW | 1221268 | | 9/2004 |
| TW | 1223092 | | 11/2004 |
| TW | 200526065 | | 8/2005 |
| TW | 1239501 | | 9/2005 |
| TW | 200727247 | | 7/2007 |
| WO | WO 98/11554 | | 3/1998 |
| WO | WO 1998/48403 | | 10/1998 |
| WO | WO 99/48079 | | 9/1999 |
| WO | WO 1999/48079 | | 9/1999 |
| WO | WO 2001/06484 | | 1/2001 |

(56) References Cited

FOREIGN PATENT DOCUMENTS

| | | | |
|---|---|---|---|
| WO | WO 01/27910 | A1 | 4/2001 |
| WO | WO 2001/27910 | A1 | 4/2001 |
| WO | WO 2001/63587 | A2 | 8/2001 |
| WO | WO 02/067327 | A | 8/2002 |
| WO | WO 2002/067327 | A | 8/2002 |
| WO | WO 2003/001496 | A1 | 1/2003 |
| WO | WO 03/034389 | | 4/2003 |
| WO | WO 2003/034389 | A | 4/2003 |
| WO | WO 03/063124 | | 7/2003 |
| WO | WO 2003/058594 | A1 | 7/2003 |
| WO | WO 2003/063124 | | 7/2003 |
| WO | WO 03/075256 | | 9/2003 |
| WO | WO 2003/077231 | | 9/2003 |
| WO | WO 2004/003877 | | 1/2004 |
| WO | WO 2004/015668 | A1 | 2/2004 |
| WO | WO 2004/025615 | A | 3/2004 |
| WO | WO 2004/034364 | | 4/2004 |
| WO | WO 2004/047058 | | 6/2004 |
| WO | WO 2004/066249 | A1 | 8/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO/2005/034072 | A1 | 4/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/000101 | A1 | 1/2006 |
| WO | WO 2006/053424 | | 5/2006 |
| WO | WO 2006/063448 | | 6/2006 |
| WO | WO 2006/063448 | A | 6/2006 |
| WO | WO 2006/084360 | | 8/2006 |
| WO | WO 2006/128069 | | 11/2006 |
| WO | WO 2007/003877 | A | 1/2007 |
| WO | WO 2007/079572 | | 7/2007 |
| WO | WO 2007/120849 | A2 | 10/2007 |
| WO | WO 2008/057369 | | 5/2008 |
| WO | WO 2008/0290805 | | 11/2008 |
| WO | WO 2009/048618 | | 4/2009 |
| WO | WO 2009/055920 | | 5/2009 |
| WO | WO 2009/059028 | | 5/2009 |
| WO | WO 2009/127065 | | 10/2009 |
| WO | WO 2010/023270 | | 3/2010 |
| WO | WO 2010/066030 | | 6/2010 |
| WO | WO 2010/120733 | | 10/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander : "Pixel circuits and drive schemes for glass and elastic AMOLED displays"; dated Jul. 2005 (9 pages).
Alexander : "Unique Electrical Measurement Technology for Compensation Inspection and Process Diagnostics of AMOLED HDTV"; dated May 2010 (4 pages).
Ashtiani : "AMOLED Pixel Circuit With Electronic Compensation of Luminance Degradation"; dated Mar. 2007 (4 pages).
Chaji : "A Novel Driving Scheme for High Resolution Large-area a-Si:H AMOLED displays"; dated Aug. 2005 (3 pages).
Chaji : "A Current-Mode Comparator for Digital Calibration of Amorphous Silicon AMOLED Displays"; dated Jul. 2008 (5 pages).
Chaji : "A fast settling current driver based on the CCII for AMOLED displays"; dated Dec. 2009 (6 pages).
Chaji : "A Low-Cost Stable Amorphous Silicon AMOLED Display with Full V~T- and V~O~L~E~D Shift Compensation"; dated May 2007 (4 pages).
Chaji : "A low-power driving scheme for a-Si:H active-matrix organic light-emitting diode displays"; dated Jun. 2005 (4 pages).
Chaji : "A low-power high-performance digital circuit for deep submicron technologies"; dated Jun. 2005 (4 pages).
Chaji : "A novel a-Si:H AMOLED pixel circuit based on short-term stress stability of a-Si:H TFTs"; dated Oct. 2005 (3 pages).
Chaji : "A Novel Driving Scheme and Pixel Circuit for AMOLED Displays"; dated Jun. 2006 (4 pages).
Chaji : "A novel driving scheme for high-resolution large-area a-Si:H AMOLED displays"; dated Aug. 2005 (4 pages).
Chaji : "A Stable Voltage-Programmed Pixel Circuit for a-Si:H AMOLED Displays"; dated Dec. 2006 (12 pages).
Chaji : "A Sub-μA fast-settling current-programmed pixel circuit for AMOLED displays"; dated Sep. 2007.
Chaji : "An Enhanced and Simplified Optical Feedback Pixel Circuit for AMOLED Displays"; dated Oct. 2006.
Chaji : "Compensation technique for DC and transient instability of thin film transistor ncircuits for large-area devices"; dated Aug. 2008.
Chaji : "Driving scheme for stable operation of 2-TFT a-Si AMOLED pixel"; dated Apr. 2005 (2 pages).
Chaji : "Dynamic-effect compensating technique for stable a-Si:H AMOLED displays"; dated Aug. 2005 (4 pages).
Chaji : "Electrical Compensation of OLED Luminance Degradation"; dated Dec. 2007 (3 pages).
Chaji : "eUTDSP: a design study of a new VLIW-based DSP architecture"; dated May 2003 (4 pages).
Chaji : "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji : "High-precision fast current source for large-area current-programmed a-Si flat panels"; dated Sep. 2006 (4 pages).
Chaji : "Low-Cost AMOLED Television with IGNIS Compensating Technology"; dated May 2008 (4 pages).
Chaji : "Low-Cost Stable a-Si:H AMOLED Display for Portable Applications"; dated Jun. 2006 (4 pages).
Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage-Programmed Active-Matrix OLED Displays"; dated May 2007 (6 pages).
Chaji : "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High-Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated May 2008 (177 pages).
Chapter 3: Color Spaces"Keith Jack: "Video Demystified:" A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies ; Willem den Boer: "Active Matrix Liquid Crystal Display: Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).
European Search Report Application No. 10 83 4294.0-1903 dated Apr. 8, 2013 (9 pages).
European Search Report Application No. EP 05 80 7905 dated Apr. 2, 2009 (5 pages).

(56) References Cited

OTHER PUBLICATIONS

European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
European Supplementary Search Report for Application No. EP 04 78 6662 dated Jan. 19, 2007 (2 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223, 4 dated Nov. 8, 2011 (8 pages).
Extended European Search Report Application No. EP 12 17 4465.0 European Patent Office dated Sep. 7, 2012 (9 pages).
Extended European Search Report Application No. EP 15173106.4 dated Oct. 15, 2013 (8 pages).
Extended European Search Report for Application No. 11 73 9485.8 dated Aug. 6, 2013 (14 pages).
Extended European Search Report for Application No. EP 09 73 3076.5, dated Apr. 27, (13 pages).
Extended European Search Report for Application No. EP 10834297 dated Oct. 27, 2014 (6 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Extended European Search Report for Application No. EP 11866291. 5, dated Mar. 9, 2015, (9 pages).
Extended European Search Report for Application No. EP 13794695. 0, dated Dec. 18, 2015, (9 pages).
Extended European Search Report for Application No. EP 14158051. 4, dated Jul. 29, 2014, (4 pages).
Extended European Search Report for Application No. EP 14181848. 4, dated Mar. 5, 2015, (8 pages).
Extended European Search Report for Application No. EP 16157746. 5, dated Apr. 8, 2016, (11 pages).
Extended European Search Report for Application No. EP 16192749. 6, dated Dec. 15, 2016, (17 pages).
English translation of Japanese Office Action corresponding to co-pending Japanese Patent Application No. 2014-133475, Japanese Patent Office, dated Jan. 19, 2017 (3 pages).
Fan "LTPS_TFT Pixel Circuit Compensation for TFT Threshold Voltage Shift and IR-Drop on the Power Line for Amolded Displays" 5 pages copyright 2012.
Fossum, Eric R.. "Active Pixel Sensors: Are CCD's Dinosaurs'?" SPIE: Symposium on Electronic Imaging. Feb. 1, 1993 (13 pages).
Goh "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Preliminary Report on Patentability for Application No. PCT/CA2005/001007 dated Oct. 16, 2006, 4 pages.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 dated Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB/2014/066932 dated Mar. 24, 2015.
International Search Report for Application No. PCT/IB/2016/054763 dated Nov. 25, 2016 (4 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/IB2014/058244, Canadian Intellectual Property Office, dated Apr. 11, 2014; (6 pages).

(56) References Cited

OTHER PUBLICATIONS

International Search Report for Application No. PCT/IB2014/059753, Canadian Intellectual Property Office, dated Jun. 23, 2014; (6 pages).
International Search Report for Application No. PCT/IB2014/060879, Canadian Intellectual Property Office, dated Jul. 17, 2014 (3 pages).
International Search Report for Application No. PCT/IB2014/060959, dated Aug. 28, 2014, 5 pages.
International Search Report for Application No. PCT/JP02/09668, dated Dec. 3, 2002, (4 pages).
International Search Report for Application No. 14157112.5-1903, dated Aug. 21, 2014 (7 pages).
International Searching Authority Written Opinion Application No. PCT/IB2010/055481 dated Apr. 7, 2011 (6 pages).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
International Searching Authority Written Opinion Application No. PCT/IB2013/059074, dated Dec. 18, 2013 (8 pages ).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
Jafarabadiashtiani : "A New Driving Method for a-Si AMOLED Displays Based on Voltage Feedback"; dated May 2005 (4 pages).
Kanicki, J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee : "Ambipolar Thin-Film Transistors Fabricated by PECVD Nanocrystalline Silicon"; dated May 2006 (6 pages).
Lee, Wonbok: "Thermal Management in Microprocessor Chips and Dynamic Backlight Control in Liquid Crystal Displays", Ph.D. Dissertation, University of Southern California (124 pages).
Liu, P. , Innovative Voltage Driving Pixel Circuit Using Organic Thin-Film Transistor for AMOLEDs, Journal of Display Technology, vol. 5, Issue 6, Jun. 2009 (pp. 224-227).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Ma E Y: "Organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004 (4 pages).
Mendes E., "A High Resolution Switch-Current Memory Base Cell." IEEE: Circuits and Systems. vol. 2, Aug. 1999 (pp. 718-721).
Nathan A. , "Thin Film imaging technology on glass and plastic" ICM 2000, proceedings of the 12 international conference on microelectronics, dated Oct. 31, 2001 (4 pages).
Nathan "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan : "Backplane Requirements for Active Matrix Organic Light Emitting Diode Displays"; dated Sep. 2006 (16 pages).
Nathan : "Call for papers second international workshop on compact thin-film transistor (TFT) modeling for circuit simulation"; dated Sep. 2009 (1 page).
Nathan : "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated Jun. 2006 (4 pages).
Nathan : "Thin film imaging technology on glass and plastic"; dated Oct. 31-Nov. 2, 2000 (4 pages).
Office Action in Chinese Patent Invention No. 201180008188.9, dated Jun. 4, 2014 (17 pages) (w/English translation).
Office Action in Chinese Patent Invention No. 201280022957.5, dated Jun. 26, 2015 (7 pages).
Office Action in Japanese patent application No. JP2012-541612 dated Jul. 15, 2014. (3 pages).
Ono "Shared Pixel Compensation Circuit for AM-OLED Displays" Proceedings of the 9th Asian Symposium on Information Display (ASID) pp. 462-465 New Delhi dated Oct. 8-12, 2006 (4 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati : "Comparison of a 17 b multiplier in Dual-rail domino and in Dual-rail D L (D L) logic styles"; dated 2002 (4 pages).
Safavaian : "Three-TFT image sensor for real-time digital X-ray imaging"; dated Feb. 2, 2006 (2 pages).
Safavian : "3-TFT active pixel sensor with correlated double sampling readout circuit for real-time medical x-ray imaging"; dated Jun. 2006 (4 pages).
Safavian : "A novel current scaling active pixel sensor with correlated double sampling readout circuit for real time medical x-ray imaging"; dated May 2007 (7 pages).
Safavian : "A novel hybrid active-passive pixel with correlated double sampling CMOS readout circuit for medical x-ray imaging"; dated May 2008 (4 pages).
Safavian : "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).
Singh "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler , System Considerations for RGBW OLED Displays, Journal of the SID 14/1, 2006, pp. 37-48.
Stewart M. "Polysilicon TFT technology for active matrix OLED displays" IEEE transactions on electron devices vol. 48 No. 5 May 2001 (7 pages).
Vygranenko : "Stability of indium-oxide thin-film transistors by reactive ion beam assisted deposition"; dated Feb. 2009.
Wang : "Indium oxides by reactive ion beam assisted evaporation: From material study to device application," dated Mar. 2009 (6 pages).

(56) References Cited

OTHER PUBLICATIONS

Written Opinion for Application No. PCT/IB/2014/066932 dated Mar. 24, 2015.
Written Opinion for Application No. PCT/IB/2016/054763 dated Nov. 25, 2016 (9 pages).
Written Opinion for Application No. PCT/IB2014/059753, Canadian Intellectual Property Office, dated Jun. 12, 2014 (6 pages).
Yi He "Current-Source a-Si:H Thin Film Transistor Circuit for Active-Matrix Organic Light-Emitting Displays" IEEE Electron Device Letters vol. 21 No. 12 Dec. 2000 pp. 590-592.
Yu, Jennifer: "Improve OLED Technology for Display", Ph.D. Dissertation, Massachusetts Institute of Technology, Sep. 2008 (151 pages).
Japanese Office Action corresponding to co-pending Japanese Patent Application No. 2014-133475, Japanese Patent Office, dated Jun. 30, 2015 (6 pages).
Chinese Patent Office, First Office Action for Chinses Application No. 201210152425.5, dated May 30, 2015, with English translation (29 pages).
English Translation of Japanese Office Action corresponding to co-pending Japanese Patent Application No. 2014-133475, dated Mar. 29, 2016 (4 pages).

* cited by examiner

METHOD AND SYSTEM FOR DRIVING A LIGHT EMITTING DEVICE DISPLAY

CROSS REFERENCE TO RELATED APPLICATIONS

This application is a continuation of U.S. patent application No. 15/090,769, filed Apr. 5, 2017, now allowed, which is a continuation of U.S. patent application No. 14/481,370, filed Sep. 9, 2014, now U.S. Pat. No. 9,330,598, which is a continuation of U.S. patent application No. 12/893,148, filed Sep. 29, 2010, now U.S. Pat. No. 8,860,636, which is a continuation of U.S. patent application No. 11/449,487, filed Jun. 8, 2006, now U.S. Pat. No. 7,852,298, which claims priority to Canadian Patent No. 2,508,972, filed Jun. 8, 2005, and Canadian Patent No. 2,537,173, filed Feb. 20, 2006, and Canadian Patent No. 2,542,678, filed Apr. 10, 2006,all of which are hereby incorporated by reference in their entireties.

FIELD OF INVENTION

The present invention relates to display technologies, more specifically a method and system for driving light emitting device displays.

BACKGROUND OF THE INVENTION

Recently active-matrix organic light-emitting diode (AMOLED) displays with amorphous silicon (a-Si), polysilicon, organic, or other driving backplane have become more attractive due to advantages over active matrix liquid crystal displays. An AMOLED display using a-Si backplanes, for example, has the advantages that include low temperature fabrication that broadens the use of different substrates and makes flexible displays feasible, and its low cost fabrication. Also, OLED yields high resolution displays with a wide viewing angle.

The AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current.

FIG. 1 illustrates conventional operation cycles for a conventional voltage-programmed AMOLED display. In FIG. 1, "Rowi" (i=1, 2, 3) represents a ith row of the matrix pixel array of the AMOLED display. In FIG. 1, "C" represents a compensation voltage generation cycle in which a compensation voltage is developed across the gate-source terminal of a drive transistor of the pixel circuit, "VT-GEN" represents a $V_T$-generation cycle in which the threshold voltage of the drive transistor, $V_T$, is generated, "P" represents a current-regulation cycle where the pixel current is regulated by applying a programming voltage to the gate of the drive transistor, and "D" represents a driving cycle in which the OLED of the pixel circuit is driven by current controlled by the drive transistor.

For each row of the AMOLED display, the operating cycles include the compensation voltage generation cycle "C", the $V_T$-generation cycle "VT-GEN", the current-regulation cycle "P", and the driving cycle "D". Typically, these operating cycles are performed sequentially for a matrix structure, as shown in FIG. 1. For example, the entire programming cycles (i.e., "C", "VT-GEN", and "P") of the first row (i.e., $Row_1$) are executed, and then the second row (i.e., $Row_2$) is programmed.

However, since the $V_T$-generation cycle "VT-GEN" requires a large timing budget to generate an accurate threshold voltage of a drive TFT, this timing schedule cannot be adopted in large-area displays. Moreover, executing two extra operating cycles (i.e., "C" and "VT-GEN") results in higher power consumption and also requires extra controlling signals leading to higher implementation cost.

SUMMARY OF THE INVENTION

It is an object of the invention to provide a method and system that obviates or mitigates at least one of the disadvantages of existing systems.

In accordance with an aspect of the present invention there is provided a display system which includes: a pixel array including a plurality of pixel circuits arranged in row and column. The pixel circuit has a light emitting device, a capacitor, a switch transistor and a drive transistor for driving the light emitting device. The pixel circuit includes a path for programming, and a second path for generating the threshold of the drive transistor. The system includes: a first driver for providing data for the programming to the pixel array; and a second driver for controlling the generation of the threshold of the drive transistor for one or more drive transistors. The first driver and the second driver drives the pixel array to implement the programming and generation operations independently.

In accordance with a further aspect of the present invention there is provided a method of driving a display system. The display system includes: a pixel array including a plurality of pixel circuits arranged in row and column. The pixel circuit has a light emitting device, a capacitor, a switch transistor and a drive transistor for driving the light emitting device. The pixel circuit includes a path for programming, and a second path for generating the threshold of the drive transistor. The method includes the steps of: controlling the generation of the threshold of the drive transistor for one or more drive transistors, providing data for the programming to the pixel array, independently from the step of controlling.

In accordance with a further aspect of the present invention there is provided a display system which includes: a pixel array including a plurality of pixel circuits arranged in row and column, The pixel circuit has a light emitting device, a capacitor, a switch transistor and a drive transistor for driving the light emitting device. The system includes: a first driver for providing data to the pixel array for programming; and a second driver for generating and storing an aging factor of each pixel circuit in a row into the corresponding pixel circuit, and programming and driving the pixel circuit in the row for a plurality of frames based on the stored aging factor. The pixel array is divided into a plurality of segments. At least one of signal lines driven by the second driver for generating the aging factor is shared in a segment.

In accordance with a further aspect of the present invention there is provided a method of driving a display system. The display system includes: a pixel array including a plurality of pixel circuits arranged in row and column. The pixel circuit has a light emitting device, a capacitor, a switch transistor and a drive transistor for driving the light emitting device. The pixel array is divided into a plurality of segments. The method includes the steps of: generating an aging factor of each pixel circuit using a segment signal and storing the aging factor into the corresponding pixel circuit for each row, the segment signal being shared by each segment; and programming and driving the pixel circuit in the row for a plurality of frames based on the stored aging factor.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

Embodiments of the present invention are described using a pixel circuit having a light emitting device, such as an organic light emitting diode (OLED), and a plurality of transistors, such as thin film transistors (TFTs), arranged in row and column, which form an AMOLED display. The pixel circuit may include a pixel driver for OLED. However, the pixel may include any light emitting device other than OLED, and the pixel may include any transistors other than TFTs. The transistors in the pixel circuit may be n-type transistors, p-type transistors or combinations thereof. The transistors in the pixel may be fabricated using amorphous silicon, nano/micro crystalline silicon, poly silicon, organic semiconductors technologies (e.g. organic TFT), NMOS/PMOS technology or CMOS technology (e.g. MOSFET). In the description, "pixel circuit" and "pixel" may be used interchangeably. The pixel circuit may be a current-programmed pixel or a voltage-programmed pixel. In the description below, "signal" and "line" may be used interchangeably.

The embodiments of the present invention involve a technique for generating an accurate threshold voltage of a drive TFT. As a result, it generates a stable current despite the shift of the characteristics of pixel elements due to, for example, the pixel aging, and process variation. It enhances the brightness stability of the OLED. Also it may reduce the power consumption and signals, resulting in low implementation cost.

A segmented timing schedule and a parallel timing schedule are described in detail. These schedules extend the timing budget of a cycle for generating the threshold voltage $V_T$ of a drive transistor. As described below, the rows in a display array are segmented and the operating cycles are divided into a plurality of categories, e.g., two categories. For example, the first category includes a compensation cycle and a $V_T$-generation cycle, while the second category includes a current-regulation cycle and a driving cycle. The operating cycles for each category are performed sequentially for each segment, while the two categories are executed for two adjacent segments. For example, while the current regulation and driving cycles are performed for the first segment sequentially, the compensation and $V_T$-generation cycles are executed for the second segment.

Figure 1:
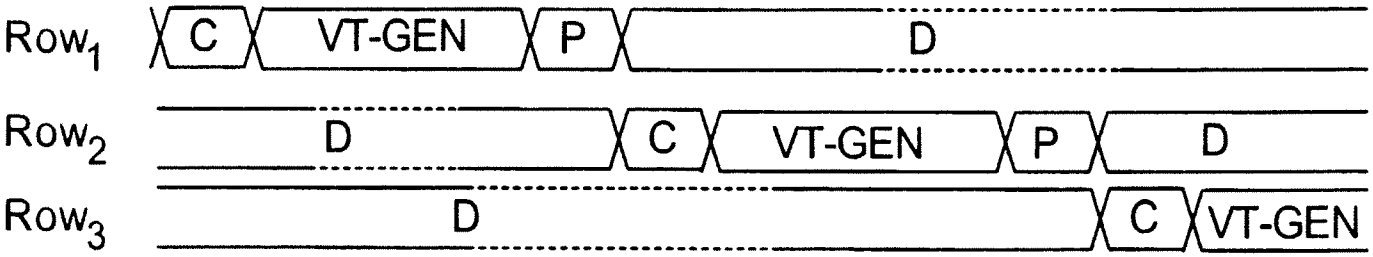
FIG. 1 illustrates conventional operating cycles for a conventional AMOLED display.
Figure 2:
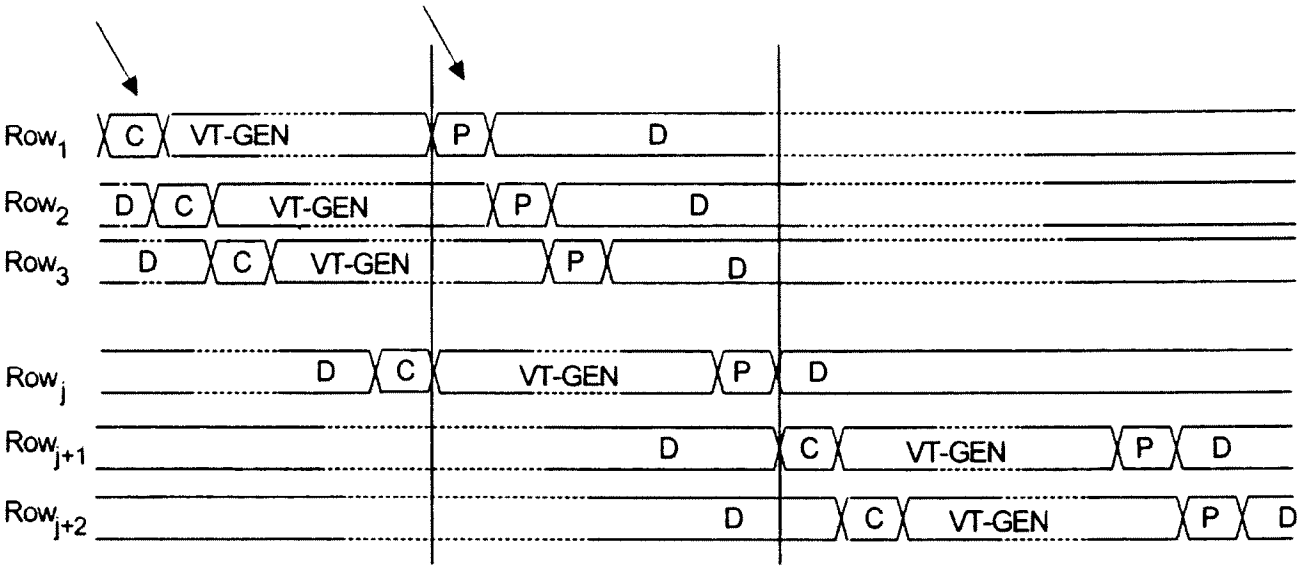
FIG. 2 illustrates an example of a segmented timing schedule for stable operation of a light emitting light display, in accordance with an embodiment of the present invention.

FIG. 2 illustrates an example of the segmented timing schedule for stable operation of a light emitting display, in accordance with an embodiment of the present invention. In FIG. 2, "$Row_k$" (k=1, 2, 3, . . . , j, j+1, j+2) represents a kth row of a display array, an arrow shows an execution direction.

For each row, the timing schedule of FIG. 2 includes a compensation voltage generation cycle "C", a $V_T$-generation cycle "VT-GEN", a current-regulation cycle "D", and a driving cycle "P".

The timing schedule of FIG. 2 extends the timing budget of the $V_T$-generation cycle "VT-GEN" without affecting the programming time. To achieve this, the rows of the display array to which the segmented addressing scheme of FIG. 2 is applied are categorized as few segments. Each segment includes rows in which the $V_T$-generation cycle is carried out consequently. In FIG. 2, $Row_1$, $Row_2$, $Row_3$, . . . , and, $Row_j$ are in one segment in a plurality of rows of the display array.

The programming of each segment starts with executing the first and second operating cycles "C" and "VT-GEN". After that, the current-calibration cycle "P" is preformed for the entire segment. As a result, the timing budget of the $V_T$-generation cycle "VT-GEN" is extended to j. $\tau_P$ where j is the number of rows in each segment, and $\tau_P$ is the timing budget of the first operating cycle "C" (or current regulation cycle).

Also, the frame time $\tau_F$ is $Z \times n \times \tau_P$ where n is the number of rows in the display, and Z is a function of number of iteration in a segment. For example, in FIG. 2, the $V_T$ generation starts from the first row of the segment and goes to the last row (the first iteration) and then the programming starts from the first row and goes to the last row (the second iteration). Accordingly, Z is set to 2. If the number of iteration increases, the frame time will become $Z \times n \times \tau_P$ in which Z is the number of iteration and may be greater than 2.

Figure 3:
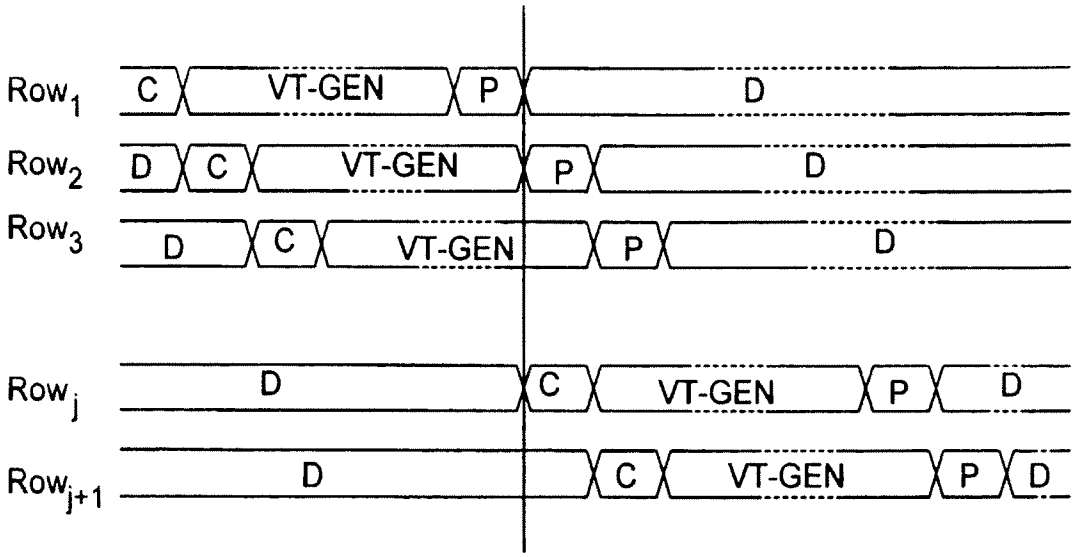
FIG. 3 illustrates an example of a parallel timing schedule for stable operation of a light emitting light display, in accordance with an embodiment of the present invention.

FIG. 3 illustrates an example of the parallel timing schedule for stable operation of a light emitting light display, in accordance with an embodiment of the present invention. In FIG. 3, "$Row_k$" (k=1, 2, 3, . . . , j, j+1) represents a kth row of a display array.

Figure 4:
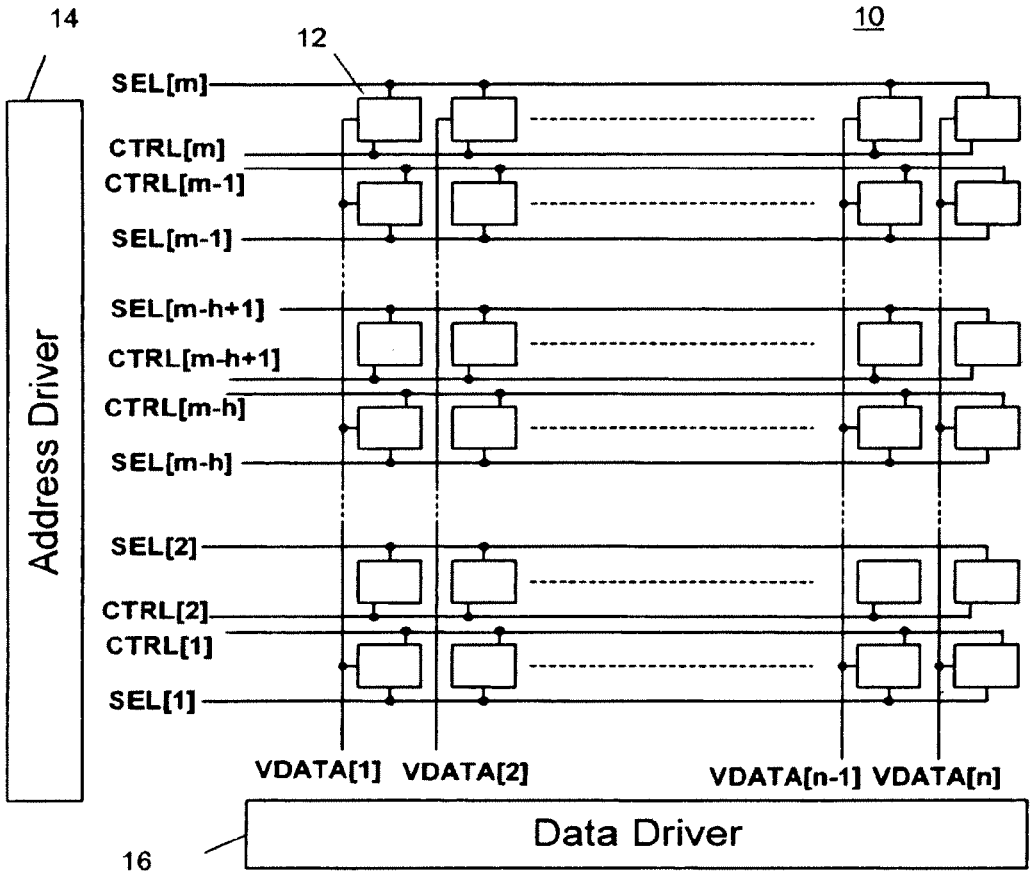
FIG. 4 illustrates an example of an AMOLED display array structure for the timing schedules of FIGS. 2 and 3.

Similar to FIG. 2, the timing schedule of FIG. 4 includes the compensation voltage generation cycle "C", the $V_T$-generation cycle "VT-GEN", the current-regulation cycle "P", and the driving cycle "D", for each row.

The timing schedule of FIG. 3 extends the timing budget of the $V_T$-generation cycle "VT-GEN", whereas $\tau_P$ is preserved as $\tau_F/n$, where $\tau_P$ is the timing budget of the first operating cycle "C", $\tau_F$ is a frame time, and n is the number of rows in the display array. In FIG. 3, $Row_1$ to $Row_j$ are in a segment in a plurality of rows of the display array.

According to the above addressing scheme, the current-regulation cycle "P" of each segment is preformed in parallel with the first operating cycles "C" of the next segment. Thus, the display array is designed to support the parallel operation, i.e., having capability of carrying out different cycles independently without affecting each other, e.g., compensation and programming, $V_T$-generation and current regulation.

FIG. 4 illustrates an example of an example of an AMOLED display array structure for the the timing schedules of FIGS. 2 and 3. In FIG. 4, SEL[a] (a=1, . . . , m) represents a select signal to select a row, CTRL[b] (b=1, . . . , m) represents a controlling signal to generate the threshold voltage of the drive TFT at each pixel in the row, and VDATA[c] (c=1, . . . , n) represents a data signal to provide a programming data. The AMOLED display 10 of FIG. 4 includes a plurality of pixel circuits 12 which are arranged in row and column, an address driver 14 for controlling SEL[a] and CTRL[b], and a data driver 16 for controlling VDATA[c]. The rows of the pixel circuits 12 (e.g., $Row_1$, . . . , $Row_{m-h}$ and $Row_{m-h+1}$, . . . , $Row_m$) are segmented as described above. To implement certain cycles in parallel, the AMOLED display 10 is designed to support the parallel operation.

Figure 5:
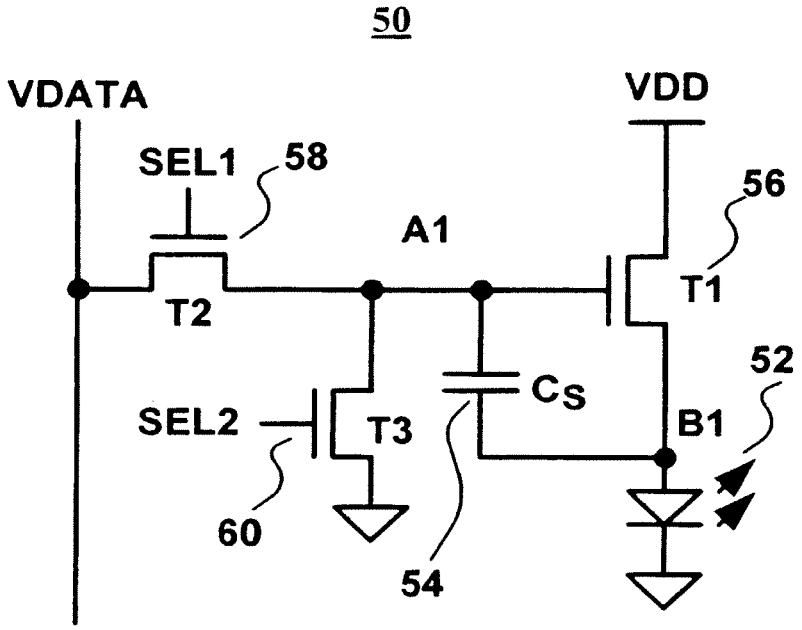
FIG. 5 illustrates an example of a voltage programmed pixel circuit to which the segmented timing schedule and the parallel timing schedule are applicable.

FIG. 5 illustrates an example of a pixel circuit to the segmented timing schedule and parallel timing schedule are applicable. The pixel circuit 50 of FIG. 5 includes an OLED 52, a storage capacitor 54, a drive TFT 56, and switch TFTs 58 and 60. A select line SEL1 is connected to the gate terminal of the switch TFT 58. A select line SEL2 is connected to the gate terminal of the switch TFT 60. The first terminal of the switch TFT 58 is connected to a data line VDATA, and the second terminal of the switch TFT 58 is connected to the gate of the drive TFT 56 at node A1. The first terminal of the switch TFT 60 is connected to node A1, and the second terminal of the switch TFT 60 is connected to a ground line. The first terminal of the drive TFT 56 is connected to a controllable voltage supply VDD, and the second terminal of the drive TFT 56 is connected to the anode electrode of the OLED 52 at node B1. The first terminal of the storage capacitor 54 is connected to node A1, and the second terminal of the storage capacitor 54 is connected to node B1. The pixel circuit 50 can be used with the segmented timing schedule, the parallel timing schedule, and a combination thereof.

$V_T$-generation occurs through the transistors 56 and 60, while current regulation is performed by the transistor 58 through the VDATA line. Thus, this pixel is capable of implementing the parallel operation.

Figure 6:
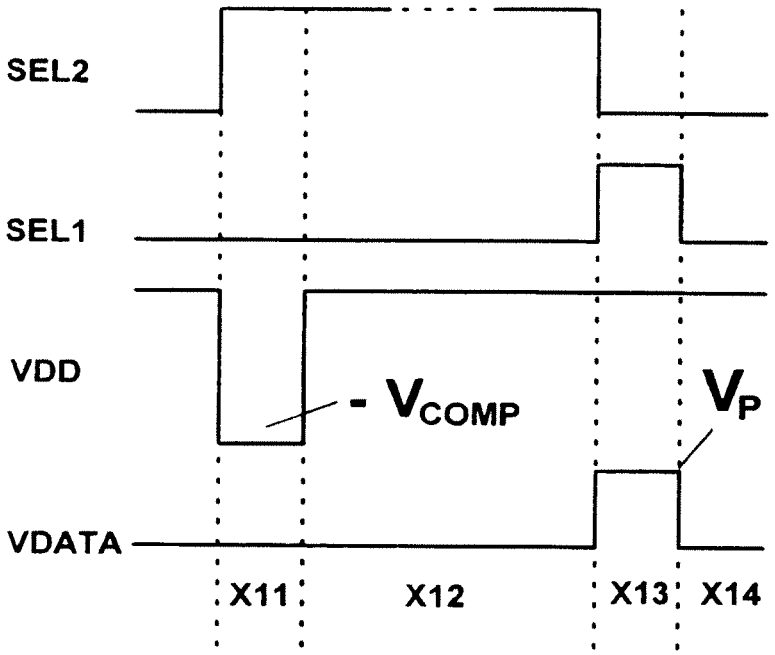
FIG. 6 illustrates an example of a timing schedule applied to the pixel circuit of FIG. 5.
Figure 7:
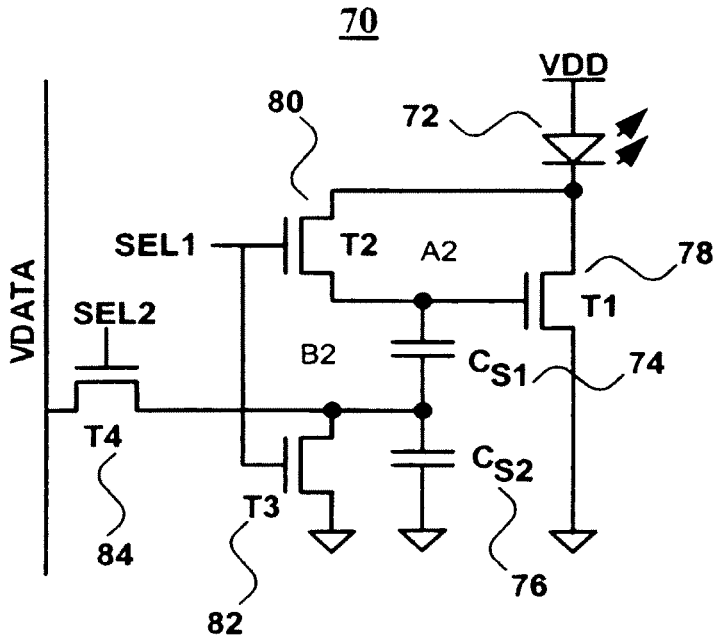
FIG. 7 illustrates another example of a voltage programmed pixel circuit to which the segmented timing schedule and the parallel timing schedule are applicable.

FIG. 6 illustrates an example of a timing schedule applied to the pixel circuit 50. In FIG. 7, "X11", "X12", "X13", and "X14" represent operating cycles. X11 corresponds to "C" of FIGS. 2 and 3, X12 corresponds to "VT-GEN" of FIGS. 2 and 3, X13 corresponds to "P" of FIGS. 2 and 3, and X14 corresponds to "D" of FIGS. 2 and 3.

Referring to FIGS. 5 and 6, the storage capacitor 54 is charged to a negative voltage (−Vcomp) during the first operating cycle X11, while the gate voltage of the drive TFT 56 is zero. During the second operating cycle X12, node B1 is charged up to $-V_T$ where $V_T$ is the threshold of the drive TFT 56. This cycle X12 can be done without affecting the data line VDATA since it is preformed through the switch transistor 60, not the switch transistor 58, so that the other operating cycle can be executed for the other rows. During the third operating cycle X13, node A1 is charged to a programming voltage $V_P$, resulting in $V_{GS}=V_P+V_T$ where $V_{GS}$ represents a gate-source voltage of the drive TFT 56.

FIG. 7 illustrates another example of a pixel circuit to the segmented timing schedule and the parallel timing schedules are applicable. The pixel circuit 70 of FIG. 7 includes an OLED 72, storage capacitors 74 and 76, a drive TFT 78, and switch TFTs 80, 82 and 84. A first select line SEL1 is connected to the gate terminal of the switch TFTs 80 and 82. A second select line SEL2 is connected to the gate terminal of the switch TFT 84. The first terminal of the switch TFT 80 is connected to the cathode of the OLED 72, and the second terminal of the switch TFT 80 is connected to the gate terminal of the drive TFT 78 at node A2. The first terminal of the switch TFT 82 is connected to node B2, and the second terminal of the switch TFT 82 is connected to a ground line. The first terminal of the switch TFT 84 is connected to a data line VDATA, and the second terminal of the switch TFT 84 is connected to node B2. The first terminal of the storage capacitor 74 is connected to node A2, and the second terminal of the storage capacitor 74 is connected to node B2. The first terminal of the storage capacitor 76 is connected to node B2, and the second terminal of the storage capacitor 76 is connected to a ground line. The first terminal of the drive TFT 78 is connected to the cathode electrode of the OLED 72, and the second terminal of the drive TFT 78 is coupled to a ground line. The anode electrode of the OLED 72 is coupled to a controllable voltage supply VDD. The pixel circuit 70 has the capability of adopting the segmented timing schedule, the parallel timing schedule, and a combination thereof.

$V_T$-generation occurs through the transistors 78, 80 and 82, while current regulation is performed by the transistor 84 through the VDATA line. Thus, this pixel is capable of implementing the parallel operation.

Figure 8:
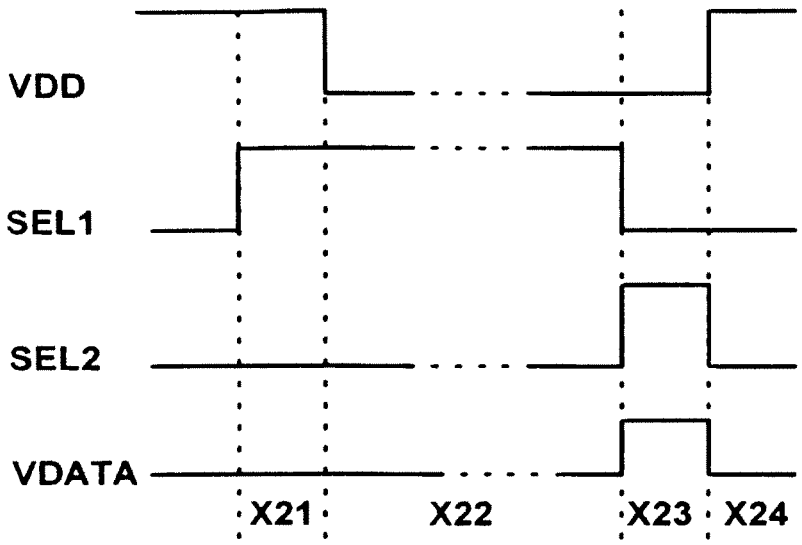
FIG. 8 illustrates an example of a timing schedule applied to the pixel circuit of FIG. 7.

FIG. 8 illustrates an example of a timing schedule applied to the pixel circuit 70. In FIG. 8, "X21", "X22", "X23", and "X24" represent operating cycles. X21 corresponds to "C" of FIGS. 2 and 3, X22 corresponds to "VT-GEN" of FIGS. 2 and 3, X23 corresponds to "P" of FIGS. 2 and 3, and X24 corresponds to "D" of FIGS. 2 and 3.

Referring to FIGS. 7 and 8, the pixel circuit 70 employs bootstrapping effect to add a programming voltage to the stored $V_T$ where $V_T$ is the threshold voltage of the drive TFT 78. During the first operating cycle x21, node A2 is charged to a compensating voltage, VDD-$V_{OLED}$ where $V_{OLED}$ is a voltage of the OLED 72, and node B2 is discharged to ground. During the second operating cycle X22, voltage at node A2 is changed to the $V_T$ of the drive TFT 78. The current regulation occurs in the third operating cycle X23 during which node B2 is charged to a programming voltage $V_P$ so that node A2 changes to $V_P+V_T$.

The segmented timing schedule and the parallel timing schedule described above provide enough time for the pixel circuit to generate an accurate threshold voltage of the drive TFT. As a result, it generates a stable current despite the pixel aging, process variation, or a combination thereof. The operating cycles are shared in a segment such that the programming cycle of a row in the segment is overlapped with the programming cycle of another row in the segment. Thus, they can maintain high display speed, regardless of the size of the display.

A shared signaling addressing scheme is described in detail. According to the shared signaling addressing scheme, the rows in the display array are divided into few segments. The aging factor (e.g., threshold voltage of the drive TFT, OLED voltage) of the pixel circuit is stored in the pixel. The stored aging factor is used for a plurality of frames. One or more signals required to generate the aging factor are shared in the segment.

For example, the threshold voltage $V_T$ of the drive TFT is generated for each segment at the same time. After that, the segment is put on the normal operation. All extra signals besides the data line and select line required to generate the threshold voltage (e.g., VSS of FIG. 10) are shared between the rows in each segment. Considering that the leakage current of the TFT is small, using a reasonable storage capacitor to store the $V_T$ results in less frequent compensation cycle. As a result, the power consumption reduces dramatically.

Since the $V_T$-generation cycle is carried out for each segment, the time assigned to the $V_T$-generation cycle is extended by the number of rows in a segment leading to more precise compensation. Since the leakage current of a-Si: TFTs is small (e.g., the order of $10^{-14}$), the generated $V_T$ can be stored in a capacitor and be used for several other frames. As a result, the operating cycles during the next post-compensation frames are reduced to the programming and driving cycles. Consequently, the power consumption associated with the external driver and with charging/discharging the parasitic capacitances is divided between the same few frames.

Figure 9:
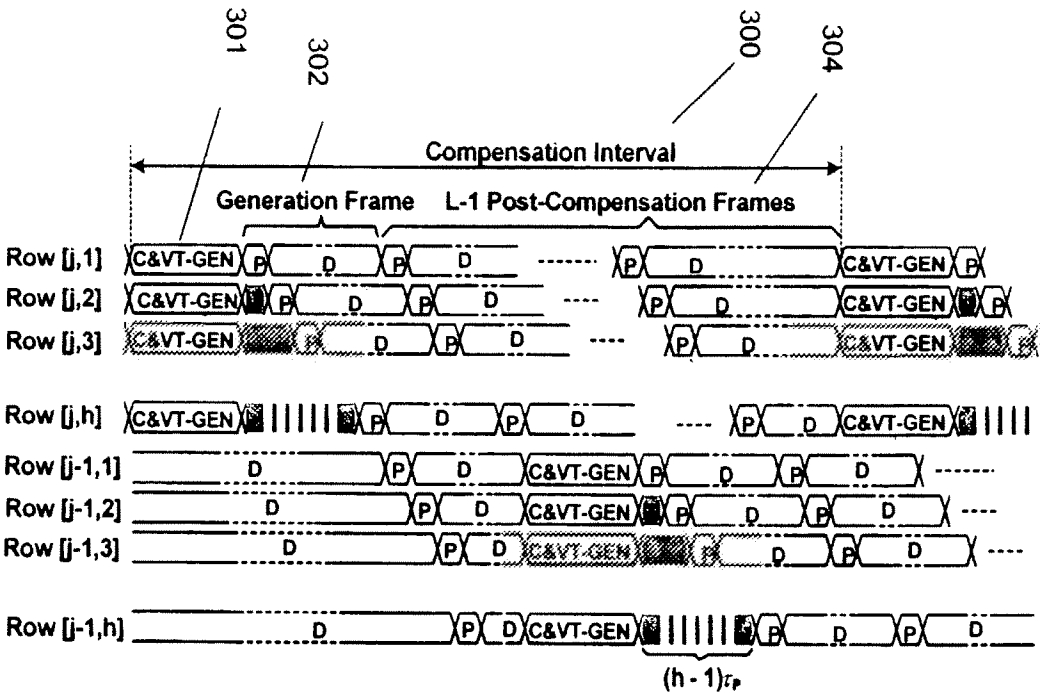
FIG. 9 illustrates an example of a shared signaling addressing scheme for a light emitting display, in accordance with an embodiment of the present invention.

FIG. 9 illustrates an example of the shared signaling addressing scheme for a light emitting light display, in accordance with an embodiment of the present invention. The shared signaling addressing scheme reduces the interface and driver complexity.

A display array to which the shared signaling addressing scheme is applied is divided into few segments, similar to those for FIGS. 2 and 3. In FIG. 9, "Row [j, k]" (k=1, 2, 3, . . . , h) represents the $k^{th}$ row in the $j^{th}$ segment, "h" is the number of row in each segment, and "L" is the number of frames that use the same generated $V_T$. In FIG. 9, "Row [j, k]" (k=1, 2, 3, . . . , h) is in a segment, and "Row [j−1, k]" (k=1, 2, 3, . . . , h) is in another segment.

The timing schedule of FIG. 9 includes compensation cycles "C & VT-GEN" (e.g. 301 of FIG. 9), a programming cycle "P", and a driving cycle "D". A compensation interval 300 includes a generation frame cycle 302 in which the threshold voltage of the drive TFT is generated and stored inside the pixel, compensation cycles "C & VT-GEN" (e.g. 301 of FIG. 9), besides the normal operation of the display, and L−1 post compensation frames cycles 304 which are the normal operation frame. The generation frame cycle 302 includes one programming cycle "P" and one driving cycle "D". The L−1 post compensation frames cycle 304 includes a set of the programming cycle "P" and the driving cycle "D", in series.

As shown in FIG. 9, the driving cycle of each row starts with a delay of $\tau_P$ from the previous row where $\tau_P$ is the timing budget assigned to the programming cycle "P". The timing of the driving cycle "D" at the last frame is reduced for each rows by $i*\tau_P$ where "i" is the number of rows before that row in the segment (e.g., (h−1) for Row [j, h]).

Figure 10:
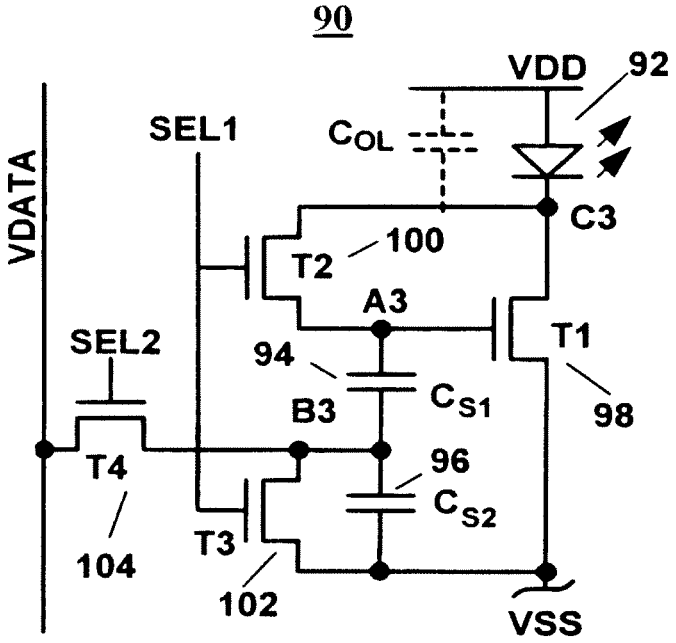
FIG. 10 illustrates an example of a pixel circuit to which the shared signaling addressing scheme is applicable.

Since $\tau_P$ (e.g., the order of 10 μs) is much smaller than the frame time (e.g., the order of 16 ms), the latency effect is negligible. However, to minimize this effect, the programming direction may be changed each time, so that the average brightness lost due to latency becomes equal for all the rows or takes into consideration this effect in the programming voltage of the frames before and after the compensation cycles. For example, the sequence of programming the row may be changed after each $V_T$-generation cycle (i.e., programming top-to-bottom and bottom-to-top iteratively), FIG. 10 illustrates an example of a pixel circuit to which the shared signaling addressing scheme is applicable. The pixel circuit 90 of FIG. 10 includes an OLED 92, storage capacitors 94 and 96, a drive TFT 98, and switch TFTs 100, 102 and 104. The pixel circuit 90 is similar to the pixel circuit 70 of FIG. 7. The drive TFT 98, the switch TFT 100, and the first storage capacitor 94 are connected at node A3. The switch TFTs 102 and 104, and the first and second storage capacitors 94 and 96 are connected at node B3. The OLED 92, the drive TFT 98 and the switch TFT 100 are connected at node C3. The switch TFT 102, the second storage capacitor 96, and the drive TFT 98 are connected to a controllable voltage supply VSS.

Figure 11:
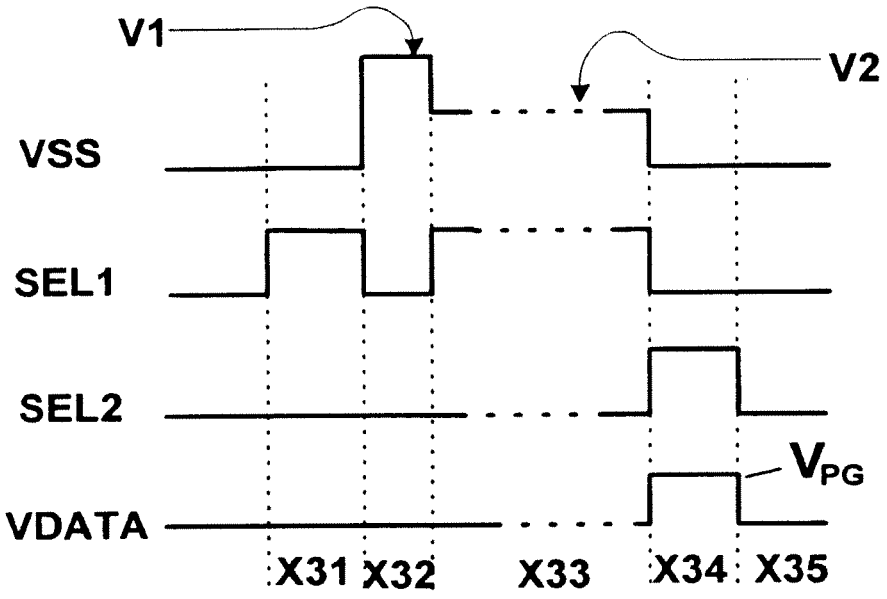
FIG. 11 illustrates an example of a timing schedule applied to the pixel circuit of FIG. 10.

FIG. 11 illustrates an example of a timing schedule applied to the pixel circuit 90. In FIG. 11, "X31", "X32", "X33", "X34", and "X35" represent operating cycles. X31, X32 and X33 correspond to the compensation cycles (e.g. 301 of FIG. 9), X34 corresponds to "P" of FIG. 9, and X35 correspond to "D" of FIG. 9.

Referring to FIGS. 10 and 11, the pixel circuit 90 employs a bootstrapping effect to add the programming voltage to the generated $V_T$ where $V_T$ is the threshold voltage of the drive TFT 98. The compensation cycles (e.g. 301 of FIG. 9) include the first three cycles X31, X32, and X33. During the first operating cycle X31, node A3 is charged to a compensation voltage, $VDD-V_{OLED}$. The timing of the first operating cycle X31 is small to control the effect of unwanted emission. During the second operating cycle X32, VSS goes to a high positive voltage V1 (for example, V1=20 V), and thus node A3 is bootstrapped to a high voltage, and also node C3 goes to V1, resulting in turning off the OLED 92. During the third operating cycle X33, the voltage at node A3 is discharged through the switch TFT 100 and the drive TFT 98 and settles to $V2+V_T$ where $V_T$ is the threshold voltage of the drive TFT 98, and V2 is, for example, 16 V. VSS goes to zero before the current-regulation cycle, and node A3 goes to $V_T$. A programming voltage $V_{PG}$ is added to the generated $V_T$ by bootstrapping during the fourth operating cycle X34. The current regulation occurs in the fourth operating cycle X34 during which node B3 is charged to the programming voltage $V_{PG}$ (for example, $V_{PG}$=6V). Thus the voltage at node A3 changes to $V_{PG}+V_T$ resulting in an overdrive voltage independent of $V_T$. The current of the pixel circuit during the fifth cycle X35 (driving cycle) becomes independent of $V_T$ shift. Here, the first storage capacitor 94 is used to store the $V_T$ during the $V_T$-generation interval.

Figure 12:
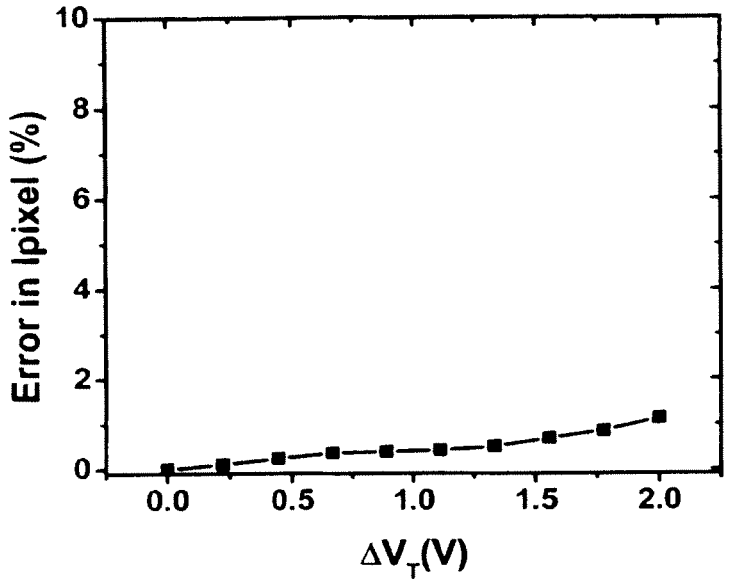
FIG. 12 illustrates the pixel current stability of the pixel circuit of FIG. 10.

FIG. 12 illustrates the pixel current stability of the pixel circuit 90 of FIG. 10. In FIG. 12, "$\Delta V_T$" represents the shift in the threshold voltage of the drive TFT (e.g., 98 of FIG. 10), and "Error in 1 pixel (%)" represents the change in the pixel current causing by $\Delta V_T$ As shown in FIG. 12, the pixel circuit 90 of FIG. 10 provides a highly stable current even after a 2-V shift in the $V_T$ of the drive TFT.

Figure 13:
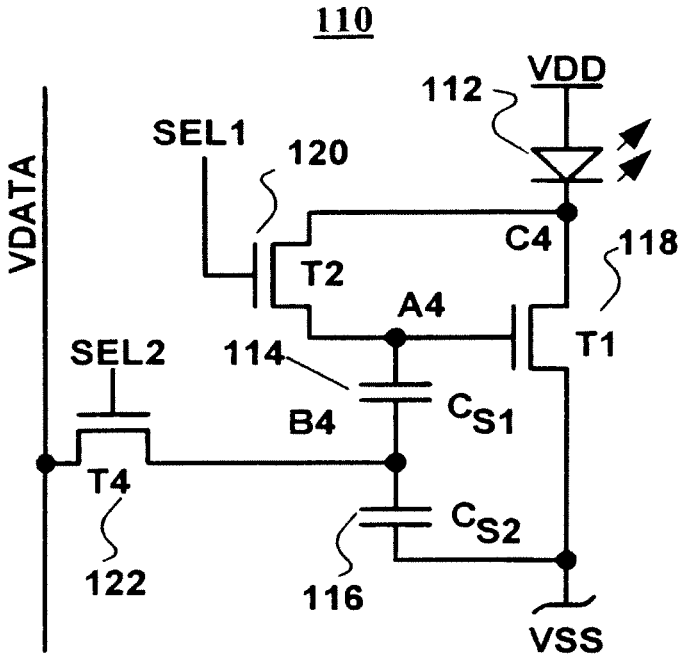
FIG. 13 illustrates another example of a pixel circuit to which the shared signaling addressing scheme is applicable.

FIG. 13 illustrates another example of a pixel circuit to which the shared signaling addressing scheme is applicable. The pixel circuit 110 of FIG. 13 is similar to the pixel circuit 90 of FIG. 10, and, however, includes two switch TFTs. The pixel circuit 110 includes an OLED 112, storage capacitors 114 and 116, a drive TFT 118, and switch TFTs 120 and 122. The drive TFT 118, the switch TFT 120, and the first storage capacitor 114 are connected at node A4. The switch TFTs 122 and the first and second storage capacitors 114 and 116 are connected at node B4. The cathode of the OLED 112, the drive TFT 118 and the switch TFT 120 are connected to node C4. The second storage capacitor 116 and the drive TFT 118 are connected to a controllable voltage supply VSS.

Figure 14:
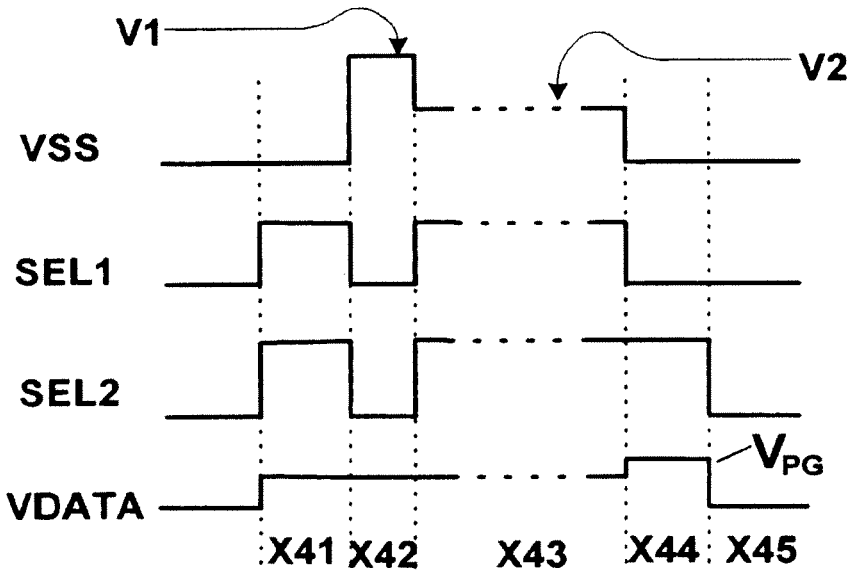
FIG. 14 illustrates an example of a timing schedule applied to the pixel circuit of FIG. 13.
Figure 15:
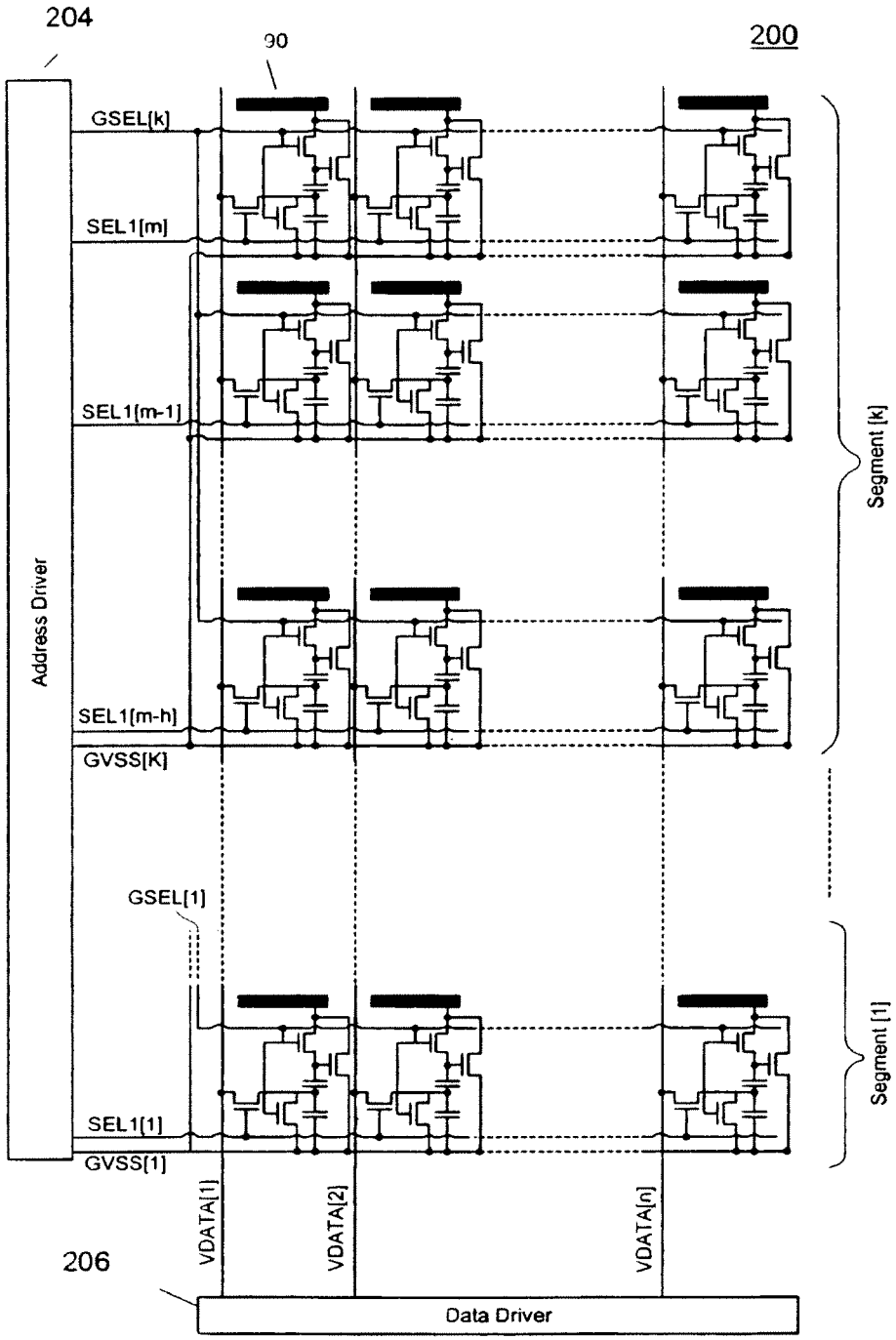
FIG. 15 illustrates an example of an AMOLED display array structure for the pixel circuit of FIG. 10.

FIG. 14 illustrates an example of a timing schedule applied to the pixel circuit 110. In FIG. 15, "X41", "X42", "X43", "X44", and "X44" represent operating cycles. X41, X42, and X43 correspond to compensation cycles (e.g. 301 of FIG. 9), X44 correspond to "P" of FIG. 9, and X45 correspond to "D" of FIG. 9.

Referring to FIGS. 13 and 14, the pixel circuit 110 employs a bootstrapping effect to add the programming voltage to the generated $V_T$. The compensation cycles (e.g. 301 of FIG. 9) include the first three cycles X41, X42, and X43. During the first operating cycle X41, node A4 is charged to a compensation voltage, VDD-$V_{OLED}$. The timing of the first operating cycle X41 is small to control the effect of unwanted emission. During the second operating cycle X42, VSS goes to a high positive voltage V1 (for example, V1=20 V), and so node A4 is bootstrapped to a high voltage, and also node C4 goes to V1, resulting in turning off the OLED 112. During the third operating cycle X43, the voltage at node A4 is discharged through the switch TFT 120 and the drive TFT 118 and settles to V2+$V_T$ where $V_T$ is the threshold voltage of the drive TFT 118 and V2 is, for example, 16 V. VSS goes to zero before the current-regulation cycle, and thus node A4 goes to $V_T$. A programming voltage $V_{PG}$ is added to the generated $V_T$ by bootstrapping during the fourth operating cycle X44. The current regulation occurs in the fourth operating cycle X44 during which node B4 is charged to the programming voltage $V_{PG}$ (for example, $V_{PG}$=6 V). Thus the voltage at node A4 changes to $V_{PG}$+$V_T$ resulting in an overdrive voltage independent of $V_T$. The current of the pixel circuit during the fifth cycle X45 (driving cycle) becomes independent of $V_T$ shift. Here, the first storage capacitor 114 is used to store the $V_T$ during the $V_T$-generation interval.

FIG. 15 illustrates an example of an AMOLED display structure for the pixel circuit of FIG. 10. In FIG. 15, GSEL[a] (a=1, . . . , k) corresponds to SEL2 of FIG. 10, SEL1[*b*] (b=1, . . . , m) corresponds to SEL1 of FIG. 10, GVSS[c] (c=1, . . . , k) corresponds to VSS of FIG. 10, VDATA[d] (d=1, . . . , n) corresponds to VDATA of FIG. 10. The AMOLED display 200 of FIG. 15 includes a plurality of pixel circuits 90 which are arranged in row and column, an address driver 204 for controlling GSEL[a], SEL1[*b*] and GVSS[c], and a data driver 206 for controlling VDATA[s]. The rows of the pixel circuits 90 are segmented as described above. In FIG. 15, segment [1] and segment [k] are shown as examples.

Referring to FIGS. 10 and 15, SEL2 and VSS signals of the rows in one segment are connected together and form GSEL and GVSS signals.

Figure 16:
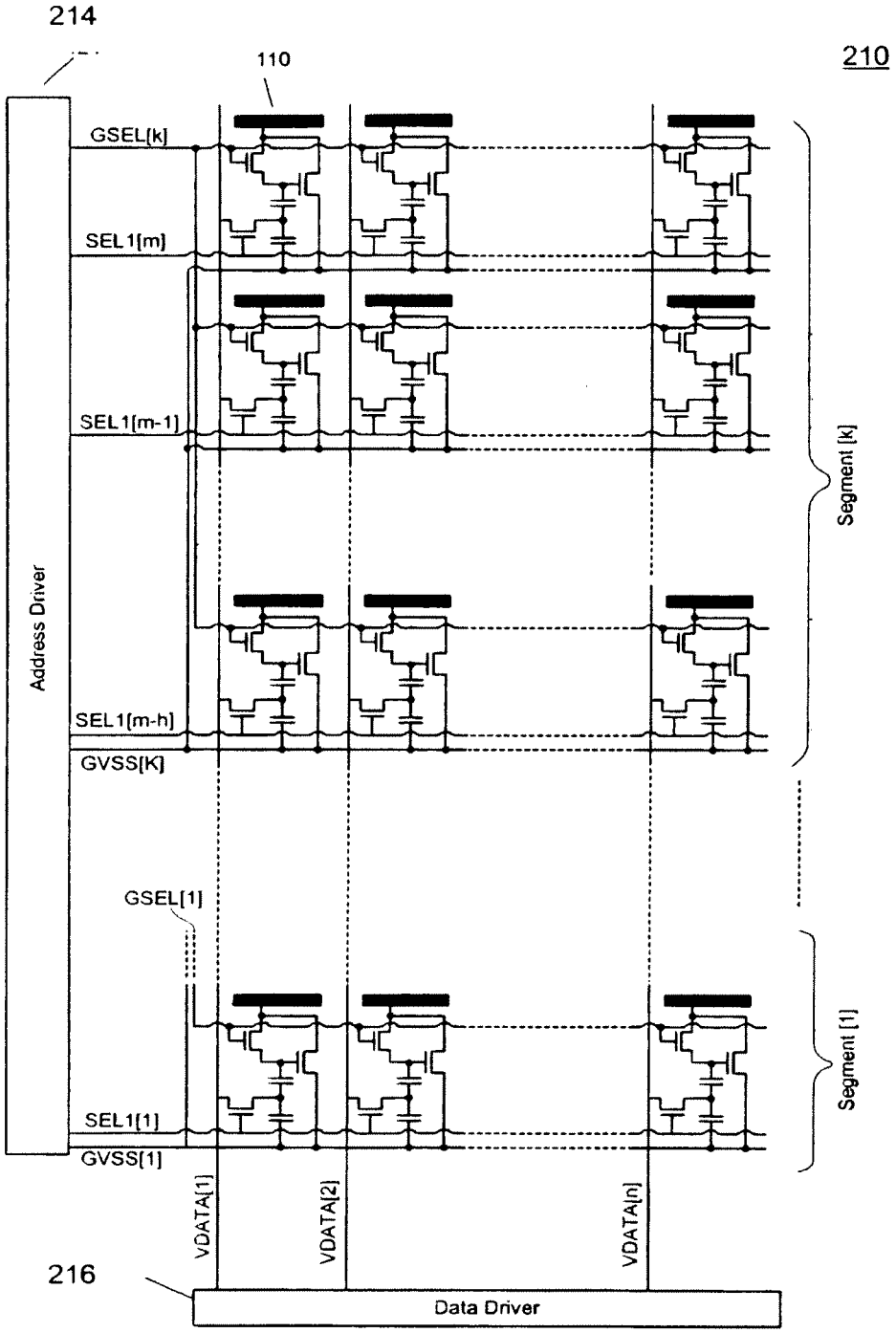
FIG. 16 illustrates an example of an AMOLED display array structure for the pixel circuit of FIG. 13.
Figure 17:
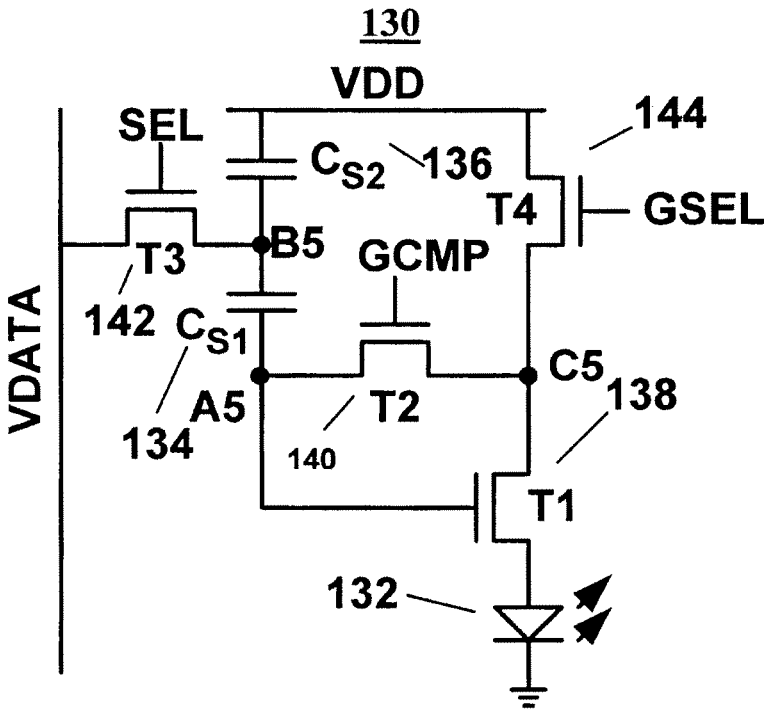
FIG. 17 illustrates a further example of a pixel circuit to which the shared signaling addressing scheme is applicable.

FIG. 16 illustrates an example of an AMOLED display structure for the pixel circuit of FIG. 14. In FIG. 17, GSEL[a] (a=1, . . . , k) corresponds to SEL2 of FIG. 14, SEL1[*b*] (b=1, . . . , m) corresponds to SEL1 of FIG. 14, GVSS[c] (c=1, . . . , k) corresponds to VSS of FIG. 14, VDATA[d] (d=1, . . . , n) corresponds to VDATA of FIG. 14. The AMOLED display 210 of FIG. 16 includes a plurality of pixel circuits 110 which are arranged in row and column, an address driver 214 for controlling GSEL[a], SEL1[*b*] and GVSS[c], and a data driver 216 for controlling VDATA[s]. The rows of the pixel circuits 110 are segmented as described above. In FIG. 15, segment [1] and segment [k] are shown as examples.

Referring to FIGS. 14 and 16, SEL2 and VSS signals of the rows in one segment are connected together and form GSEL and GVSS signals.

Referring to FIGS. 15 and 16, the display arrays can diminish its area by sharing VSS and GSEL signals between physically adjacent rows. Moreover, GVSS and GSEL in the same segment are merged together and form the segment GVSS and GSEL lines. Thus, the controlling signals are reduced. Further, the number of blocks driving the signals is also reduced resulting in lower power consumption and lower implementation cost.

FIG. 17 illustrates a further example of a pixel circuit to which the shared signaling addressing scheme is applicable. The pixel circuit of FIG. 17 includes an OLED 132, storage capacitors 134 and 136, a drive TFT 138, and switch TFTs 140, 142 and 144. A first select line SEL is connected to the gate terminal of the switch TFT 142. A second select line GSEL is connected to the gate terminal of the switch TFT 144. A GCOMP signal line is connected to the gate terminal of the switch TFT 140. The first terminal of the switch TFT 140 is connected to node A5, and the second terminal of the switch TFT 140 is connected to node C5. The first terminal of the drive TFT 138 is connected to node C5 and the second terminal of the drive TFT 138 is connected to the anode of the OLED 132. The first terminal of the switch TFT 142 is connected to a data line VDATA, and the second terminal of the switch TFT 142 is connected to node B5. The first terminal of the switch TFT 144 is connected to a voltage supply VDD, and the second terminal of the switch TFT 144 is connected to node C5. The first terminal of the first storage capacitor 134 is connected to node A5, and the second terminal of the first storage capacitor 134 is connected to node B5. The first terminal of the second storage capacitor 136 is connected to node B5, and the second terminal of the second storage capacitor 136 is connected to VDD.

Figure 18:
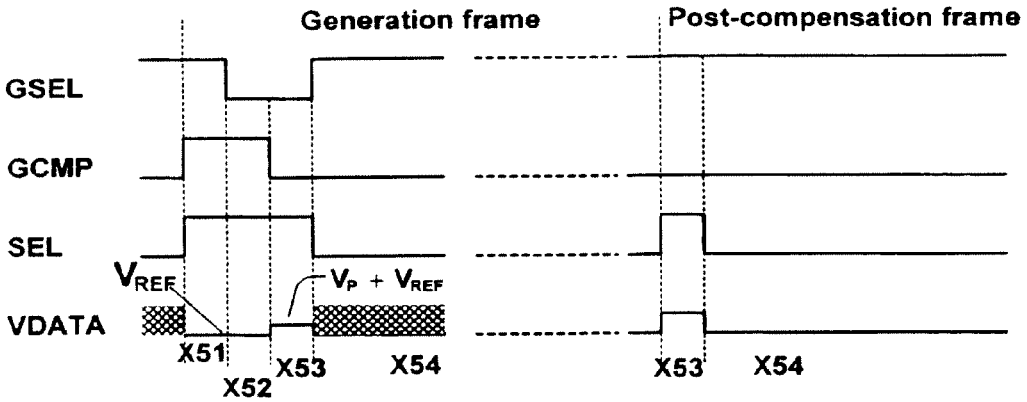
FIG. 18 illustrates an example of a timing schedule applied to the pixel circuit of FIG. 17.

FIG. 18 illustrates an example of a timing schedule applied to the pixel circuit 130. In FIG. 18, operating cycles X51, X52, X53, and X54 form a generating frame cycle (e.g., 302 of FIG. 9), the second operating cycles X53 and X54 form a post-compensation frame cycle (e.g., 304 of FIGS. 9). X53 and X54 are the normal operation cycles whereas the rest are the compensation cycles.

Referring to FIGS. 17 and 18, the pixel circuit 130 employs bootstrapping effect to add a programming voltage to the generated $V_T$ where $V_T$ is the threshold voltage of the drive TFT 138. The compensation cycles (e.g. 301 of FIG. 9) include the first two cycles X51 and X52. During the first operating cycle X51, node A5 is charged to a compensation voltage, and node B5 is charged to $V_{REF}$ through the switch TFT 142 and VDATA. The timing of the first operating cycle X51 is small to control the effect of unwanted emission.

During the second operating cycle X52, GSEL goes to zero and thus it turns off the switch TFT 144. The voltage at node A5 is discharged through the switch TFT 140 and the drive TFT 138 and settles to $V_{OLED}+V_T$ where $V_{OLED}$ is the voltage of the OLED 132, and $V_T$ is the threshold voltage of the drive TFT 138. During the programming cycle, i.e., the third operating cycle X53, node B5 is charged to $V_P+V_{REF}$ where $V_P$ is a programming voltage. Thus the gate voltage of the drive TFT 138 becomes $V_{OLED}+V_T+V_P$. Here, the first storage capacitor 134 is used to store the $V_T+V_{OLED}$ during the compensation interval.

Figure 19:
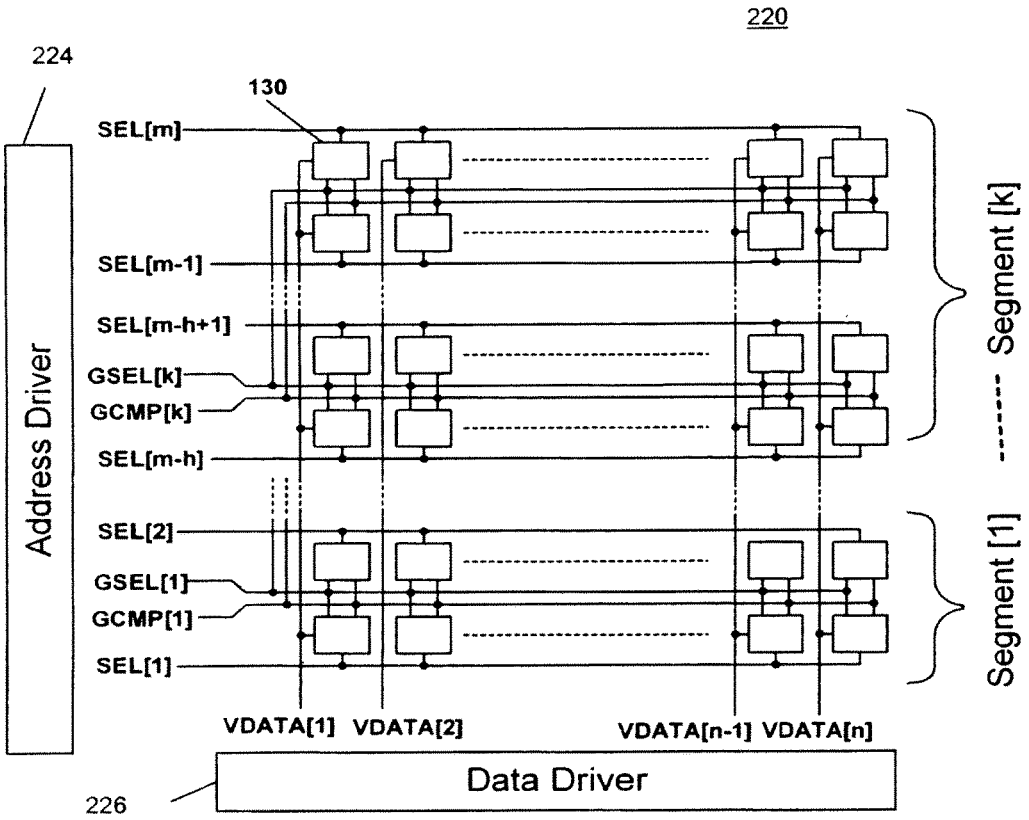
FIG. 19 illustrates an example of an AMOLED display array structure for the pixel circuit of FIG. 17.

FIG. 19 illustrates an example of an AMOLED display array structure for the pixel circuit 130 of FIG. 17. In FIG. 19, GSEL[a] (a=1, . . . , k) corresponds to GSEL of FIG. 17, SEL[b] (b=1, . . . , m) corresponds to SEL1 of FIG. 17, GCMP[c] (c=1, . . . , k) corresponds to GCOMP of FIG. 17, VDATA[d] (d=1, . . . , n) corresponds to VDATA of FIG. 17. The AMOLED display 220 of FIG. 19 includes a plurality of pixel circuits 130 which are arranged in row and column, an address driver 224 for controlling SEL[a], GSEL[b], and GCOMP[c], and a data driver 226 for controlling VDATA [c]. The rows of the pixel circuits 130 are segmented (e.g., segment [1] and segment [k]) as described above.

As shown in FIGS. 17 and 19, GSEL and GCOMP signals of the rows in one segment are connected together and form GSEL and GCOMP lines. GSEL and GCOMP signals are shared in the segment. Moreover, GVSS and GSEL in the same segment are merged together and form the segment GVSS and GSEL lines. Thus, the controlling signals are reduced. Further, the number of blocks driving the signals is also reduced resulting in lower power consumption and lower implementation cost.

Figure 20:
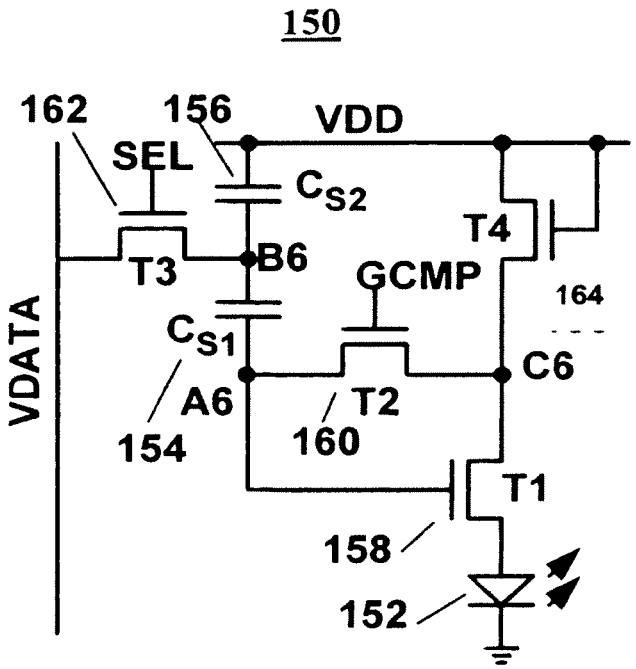
FIG. 20 illustrates a further example of a pixel circuit to which the shared signaling addressing scheme is applicable.

FIG. 20 illustrates a further example of a pixel circuit to which the shared addressing scheme is applicable. The pixel circuit 150 of FIG. 20 is similar to the pixel circuit 130 of FIG. 17. The pixel circuit 150 includes an OLED 152, storage capacitors 154 and 156, a drive TFT 158, and switch TFTs 160, 162, and 164. The gate terminal of the switch TFT 164 is connected to a controllable voltage supply VDD, rather than GSEL. The drive TFT 158, the switch TFT 162 and the first storage capacitor 154 are connected at node A6. The switch TFT 162 and the first and second storage capacitors 154 and 156 are connected at node B6. The drive TFT 158 and the switch TFTs 160 and 164 are connected to node C6.

Figure 21:
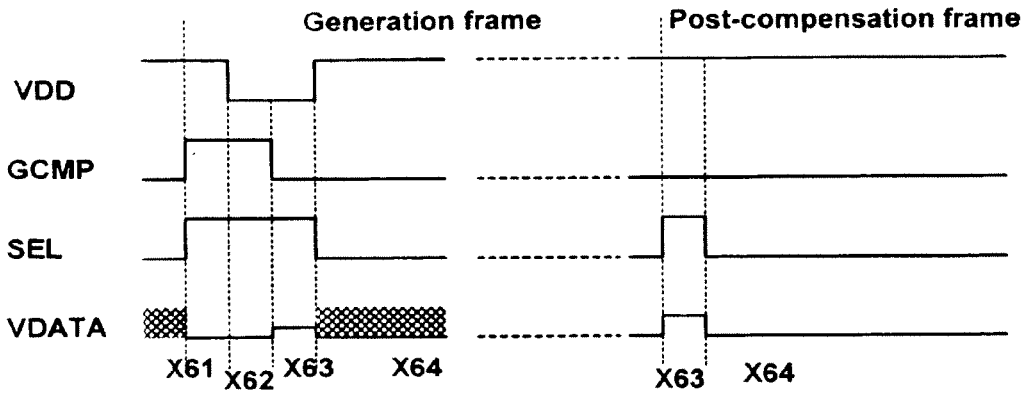
FIG. 21 illustrates an example of a timing schedule applied to the pixel circuit of FIG. 20.

FIG. 21 illustrates an example of a timing schedule applied to the pixel circuit 150. In FIG. 21, operating cycles X61, X62, X63, and X64 form a generating frame cycle (e.g., 302 of FIG. 9), the second operating cycles X63 and X64 form a post-compensation frame cycle (e.g., 304 of FIG. 9).

Referring to FIGS. 20 and 21, the pixel circuit 150 employs bootstrapping effect to add a programming voltage to the generated $V_T$ where $V_T$ is the threshold voltage of the drive TFT 158. The compensation cycles (e.g. 301 of FIG. 9) include the first two cycles X61 and X62. During the first operating cycle X61, node A6 is charged to a compensation voltage, and node B6 is charged to $V_{REF}$ through the switch TFT 162 and VDATA. The timing of the first operating cycle x61 is small to control the effect of unwanted emission. During the second operating cycle x62, VDD goes to zero and thus it turns off the switch TFT 164. The voltage at node A6 is discharged through the switch TFT 160 and the drive fn. 158 and settles to $V_{OLED}+V_T$ where $V_{OLED}$ is the voltage of the OLED 152, and $V_T$ is the threshold voltage of the drive TFT 158. During the programming cycle, i.e., the third operating cycle x63, node B6 is charged to $V_P+V_{REF}$ where $V_P$ is a programming voltage. It has been identified Thus the gate voltage of the drive TFT 158 becomes $V_{OLED}+V_T+V_P$. Here, the first storage capacitor 154 is used to store the $V_T+V_{OLED}$ during the compensation interval.

Figure 22:
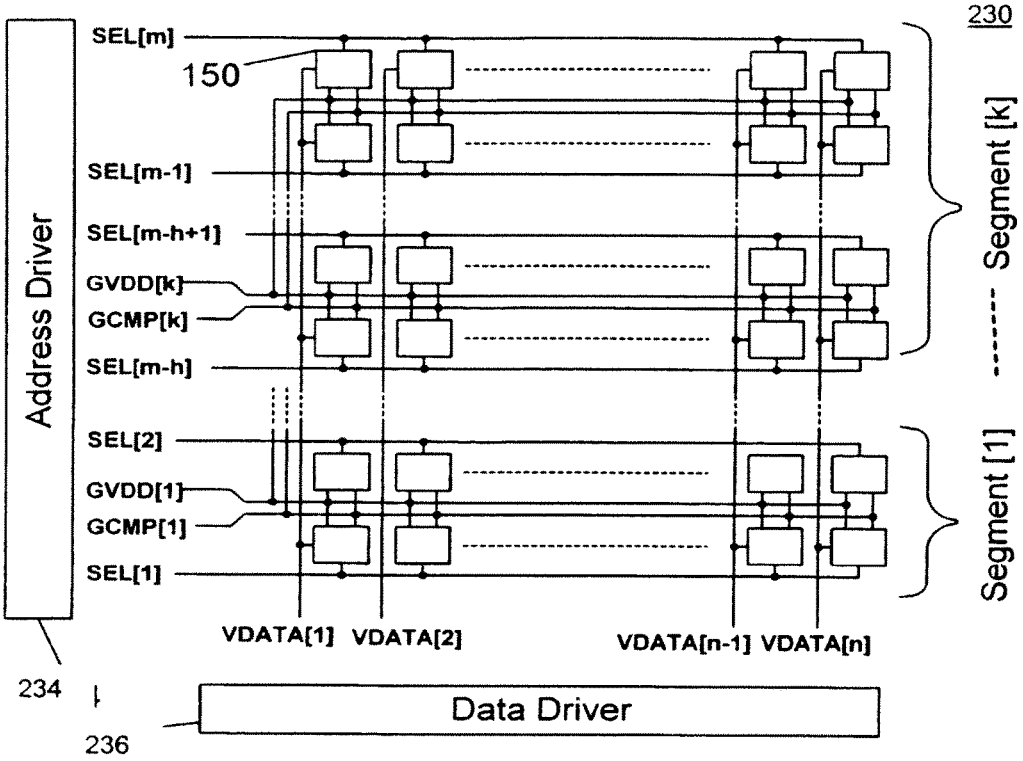
FIG. 22 illustrates an example of an AMOLED display array structure for the pixel circuit of FIG. 20.

FIG. 22 illustrates an example of an AMOLED display array structure for the pixel circuit 150 of FIG. 20. In FIG. 22, SEL[a] (a=1, . . . , m) corresponds to SEL of FIG. 22, GCMP[b] (b=1, . . . , K) corresponds to GCOMP of FIG. 22, GVDD[c] (c=1, . . . , k) corresponds to VDD of FIG. 22, and VDATA[d] (d=1, . . . , n) corresponds to VDATA of FIG. 22. The AMOLED display 230 of FIG. 22 includes a plurality of pixel circuits 150 which are arranged in row and column, an address driver 234 for controlling SEL[a], GCOMP[b], and GVDD[c], and a data driver 236 for controlling VDATA [c]. The rows of the pixel circuits 230 are segmented (e.g., segment [1] and segment [k]) as described above.

Referring to FIGS. 20 and 22, VDD and GCOMP signals of the rows in one segment are connected together and form GVDD and GCOMP lines. GVDD and GCOMP signals are shared in the segment. Moreover, GVDD and GCOMP in the same segment are merged together and form the segment GVDD and GCOMP lines. Thus, the controlling signals are reduced. Further, the number of blocks driving the signals is also reduced resulting in lower power consumption and lower implementation cost.

According to the embodiments of the present invention, the operating cycles are shared in a segment to generate an accurate threshold voltage of the drive TFT. It reduces the power consumption and signals, resulting in lower implementation cost. The operating cycles of a row in the segment are overlapped with the operating cycles of another row in the segment. Thus, they can maintain high display speed, regardless of the size of the display.

The accuracy of the generated VT depends on the time allocated to the $V_T$-generation cycle. The generated $V_T$ is a function of the storage capacitance and drive TFT parameters, as a result, the special mismatch affects the generated VT associated within the mismatch in the storage capacitor for a given threshold voltage of the drive transistor. Increasing the time of the $V_T$-generation cycle reduces the effect of special mismatch on the generated $V_T$. According to the embodiments of the present invention, the timing assigned to $V_T$ is extendable without either affecting the frame rate or reducing the number of rows, thus, it is capable of reducing the imperfect compensation and spatial mismatch effect, regardless of the size of the panel.

The $V_T$-generation time is increased to enable high-precision recovery of the threshold voltage $V_T$ of the drive TFT across its gate-source terminals. As a result, the uniformity over the panel is improved. In addition, the pixel circuits for the addressing schemes have the capability of providing a predictably higher current as the pixel ages and so as to compensate for the OLED luminance degradation.

According to the embodiments of the present invention, the addressing schemes improve the backplane stability, and also compensate for the OLED luminance degradation. The overhead in power consumption and implementation cost is reduced by over 90% compared to the existing compensation driving schemes.

Since the shared addressing scheme ensures the low power consumption, it is suitable for low power applications, such as mobile applications. The mobile applications may be, but not limited to, Personal Digital Assistants (PDAs), cell phones, etc.

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A method of driving a display system using a segmented addressing scheme, the display system comprising an array of pixel circuits divided into a plurality of segments driven according to the segmented addressing scheme, each of the plurality of segments including pixel circuits in more than one row of the array, each pixel circuit having a light emitting device, a drive transistor for driving the light emitting device to emit light, a capacitor, and a switch transistor for generating a threshold voltage of the drive transistor during a generating threshold voltage operation, the method comprising:

simultaneously controlling the switch transistors in a plurality of pixel circuits in more than one row in a first segment of the plurality of segments of the array with shared control signals, to simultaneously generate the threshold voltages of the drive transistors in the plurality of pixel circuits in the first segment during the generating threshold voltage operation for the plurality of pixel circuits in the first segment, while controlling switch transistors of every pixel circuit of every segment of the plurality of segments other than the first segment to not generate threshold voltages.

2. A method as claimed in claim 1, wherein each segment includes a plurality of rows, the simultaneously controlling the switch transistors being executed consecutively for each segment in the plurality of segments.

3. A method as claimed in claim 1, further comprising:

subsequently implementing simultaneously controlling the switch transistors of the first segment, after the simultaneously controlling the switch transistors is carried out in a second segment.

4. A display system comprising:

an array of pixel circuits divided into a plurality of segments, each of the plurality of segments driven according to a segmented addressing scheme, each of the plurality of segments including pixel circuits in more than one row of the array, each pixel circuit having a light emitting device, a drive transistor for driving the light emitting device to emit light, a capacitor, and a switch transistor for generating a threshold voltage of the drive transistor during a generating threshold voltage operation; and a driver configured to implement the segmented addressing scheme using the plurality of segments including simultaneously controlling the switch transistors in a plurality of pixel circuits in more than one row in a first segment of the plurality of segments of the array with shared control signals, to simultaneously generate the threshold voltages of the drive transistors in the plurality of pixel circuits in the first segment during the generating threshold voltage operation for the plurality of pixel circuits in the first segment, while controlling switch transistors of every pixel circuit of every segment of the plurality of segments other than the first segment to not generate threshold voltages.

5. A display system as claimed in claim 4, wherein each segment includes a plurality of rows, the driver configured to simultaneously control the switch transistors consecutively for each segment in the plurality of segments.

6. A display system as claimed in claim 4, wherein the driver is further configured to simultaneously control the switch transistors of the first segment, after simultaneously controlling the switch transistors in a second segment.

* * * * *